US010810859B2

(12) United States Patent
Tokuchi

(10) Patent No.: US 10,810,859 B2
(45) Date of Patent: Oct. 20, 2020

(54) APPARATUS, MANAGEMENT SYSTEM, AND NON-TRANSITORY COMPUTER READABLE MEDIUM

(71) Applicant: FUJI XEROX CO., LTD., Tokyo (JP)

(72) Inventor: Kengo Tokuchi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/112,799

(22) Filed: Aug. 27, 2018

(65) Prior Publication Data

US 2019/0130729 A1 May 2, 2019

(30) Foreign Application Priority Data

Oct. 26, 2017 (JP) ..... 2017-207333

(51) Int. Cl.

| | |
|---|---|
| ***G08B 21/22*** | (2006.01) |
| ***G08B 13/08*** | (2006.01) |
| ***G08B 21/24*** | (2006.01) |
| ***G08B 21/04*** | (2006.01) |

(52) U.S. Cl.

CPC ..... *G08B 21/22* (2013.01); *G08B 21/0469* (2013.01)

(58) Field of Classification Search

CPC ..... G08B 21/22

See application file for complete search history.

(56) References Cited

U.S. PATENT DOCUMENTS

| | | | | |
|---|---|---|---|---|
| 6,236,303 | B1 * | 5/2001 | Wagner | G08B 5/36 340/286.08 |
| 2014/0267735 | A1 * | 9/2014 | Carey | G07F 9/026 348/150 |
| 2015/0151008 | A1 * | 6/2015 | Smith | A61K 49/048 424/9.1 |
| 2015/0222517 | A1 * | 8/2015 | McLaughlin | H04W 4/70 713/156 |
| 2018/0012432 | A1 * | 1/2018 | Shin | G07C 9/00563 |

FOREIGN PATENT DOCUMENTS

| | | |
|---|---|---|
| JP | 2004086582 | 3/2004 |
| JP | 2004300683 | 10/2004 |
| JP | 2008158705 | 7/2008 |
| JP | 2009209580 | 9/2009 |
| JP | 2014040717 | 3/2014 |
| JP | 2017050000 | 3/2017 |

* cited by examiner

*Primary Examiner* — Joseph H Feild
*Assistant Examiner* — Pameshanand Mahase
(74) *Attorney, Agent, or Firm* — JCIPRNET

(57) ABSTRACT

An apparatus includes a controller. When an operation to set a door in a state in which the door will be opened is performed on one side of the door and if someone is on the other side of the door, the controller causes an informing unit to provide information that the door will be opened and someone is on the other side of the door.

19 Claims, 22 Drawing Sheets

1

APPARATUS, MANAGEMENT SYSTEM, AND NON-TRANSITORY COMPUTER READABLE MEDIUM

CROSS-REFERENCE TO RELATED APPLICATIONS

This application is based on and claims priority under 35 USC 119 from Japanese Patent Application No. 2017-207333 filed Oct. 26, 2017.

BACKGROUND

(i) Technical Field

The present invention relates to an apparatus, a management system, and a non-transitory computer readable medium.

(ii) Related Art

When being in a room with a door, a user is not aware of other people.

SUMMARY

According to an aspect of the invention, there is provided an apparatus including a controller. When an operation to set a door in a state in which the door will be opened is performed on one side of the door and if someone is on the other side of the door, the controller causes an informing unit to provide information that the door will be opened and someone is on the other side of the door.

BRIEF DESCRIPTION OF THE DRAWINGS

Exemplary embodiments of the present invention will be described in detail based on the following figures, wherein.

DETAILED DESCRIPTION

Exemplary embodiments of the invention will be described below with reference to the accompanying drawings.

Exemplary Embodiment

[Overall Configuration of Management System]

Due to the increased communication speed and smaller communication terminals, users can now access various items of information even outside the office. On the other hand, however, business conversations and information are highly confidential, and quiet and high-security environments are desirably provided.

In this exemplary embodiment, a management system for providing spaces that satisfy such a demand will be described. Spaces, which will be described below, are not restricted for business use, but may also be for personal use.

Figure 1:
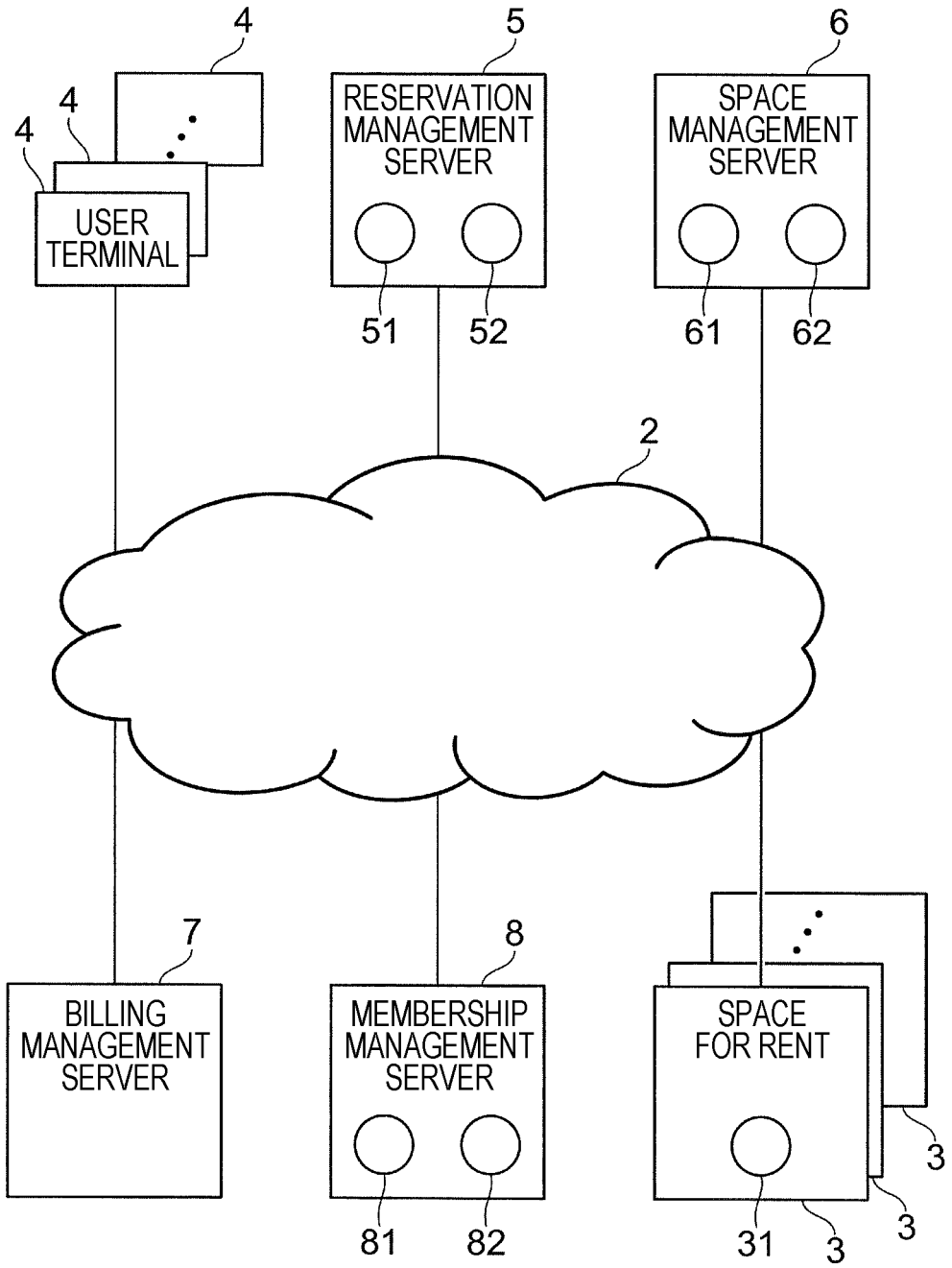
FIG. 1 schematically illustrates an example of the overall configuration of a management system.

FIG. 1 schematically illustrates an example of the overall configuration of a management system 1.

As shown in FIG. 1, the management system 1 is constituted by various terminals connected to a cloud network 2.

In the example in FIG. 1, the management system 1 includes multiple spaces 3 for rent, multiple user terminals 4, a reservation management server 5, a space management server 6, a billing management server 7, and a membership management server 8. The spaces 3 for rent are spaces to be rented on a time basis. Hereinafter, the spaces 3 for rent may simply be called the spaces 3. The user terminals 4 are carried by individual users using the spaces 3. The reservation management server 5 manages reservations for the spaces 3. The space management server 6 manages the usage statuses of the individual spaces 3. The billing management server 7 bills users for the use of the spaces 3. The membership management server 8 manages information concerning members entitled to use the spaces 3.

The spaces 3 are available twenty-four hours a day, seven days a week (24/7), except for the time reserved for maintenance, for example.

In the management system 1 shown in FIG. 1, one server is provided for one purpose (function). Alternatively, plural servers may be provided for one purpose (function). Conversely, one server may be provided for multiple purposes (functions).

Renting services for the spaces 3 may be provided by one business operator or plural business operators. For example, different business operators may separately conduct management concerning reservations, access to and usage statuses of the spaces 3, billing for the use of the spaces 3, and members registered as users. Alternatively, multiple business operators may conduct management concerning one purpose (function) collaboratively.

Plural servers may be provided for one purpose (function). If a single business operator provides plural servers for one purpose (function) or provides plural servers for multiple purposes (functions), the plural servers are connected to each other via an intranet.

The spaces 3 may be provided by a single business operator or plural business operators.

The management system 1 may be implemented as an aggregation of services provided by plural business operators.

In this exemplary embodiment, a digital key is used for locking and unlocking a space 3. A digital key is stored in a user terminal 4 or an integrated circuit (IC) card which supports near field communication (NFC) (not shown). If a user terminal 4 is used as a digital key, a digital key is provided from the reservation management server 5 to the user terminal 4 after a reservation is confirmed. If an IC card is used as a digital key, an IC card having a digital key recorded thereon is distributed from the reservation management server 5 to a user terminal 4 after a reservation is confirmed.

The use of a digital key makes it possible to freely determine an effective time period for which a space 3 can be locked and unlocked. Multiple digital keys for using one space 3 for the same time period may be issued.

Alternatively, multiple physical keys may be provided according to the reserved time to lock and unlock a space 3. User authentication may alternatively be conducted instead of the use of a key or as a function for supporting the use of a digital key or a physical key.

The reservation management server 5 manages a registration list 51 and a reservation list 52. In the registration list 51, vacancies for spaces 3 are registered. The reservation management server 5 manages the allocation of reservation holders to the spaces 3 by using the reservation list 52.

In this exemplary embodiment, the reservation management server 5 receives reservation requests for the spaces 3 24/7, except for the time reserved for maintenance, for example. The reservation management server 5 also issues digital keys to the user terminals 4 and conducts authentication if necessary. The space management server 6 may alternatively conduct authentication.

The space management server 6 manages information 61 concerning access to the individual spaces 3 and information 62 concerning the usage statuses of the individual spaces 3. The space management server 6 also serves the function of communicating with an authentication unit 32A (see FIG. 2) disposed in a space 3 to decide whether to permit a user to enter this space 3. When conducting authentication, the space management server 6 communicates with the reservation management server 5.

The space management server 6 also serves the function of collecting information from various devices 31 disposed in a space 3 and controlling the various devices 31.

The space management server 6 is connected to the cloud network 2 in FIG. 1. However, some or all of the functions of the space management server 6 may be integrated in a space 3.

The billing management server 7 serves the function of billing an individual member (may be a natural person (individual) or a legal person (enterprise)) based on reservation information, user information, information concerning access to a space 3. The billing management server 7 obtains reservation information from the reservation management server 5, information concerning access to a space 3 from the space management server 6, and membership information from the membership management server 8.

The membership management server 8 manages information concerning registered members and information concerning users. If a member is an individual person, the member is a user using a space 3. If a member is an enterprise, individual users are registered and managed according to the member.

Figure 2:
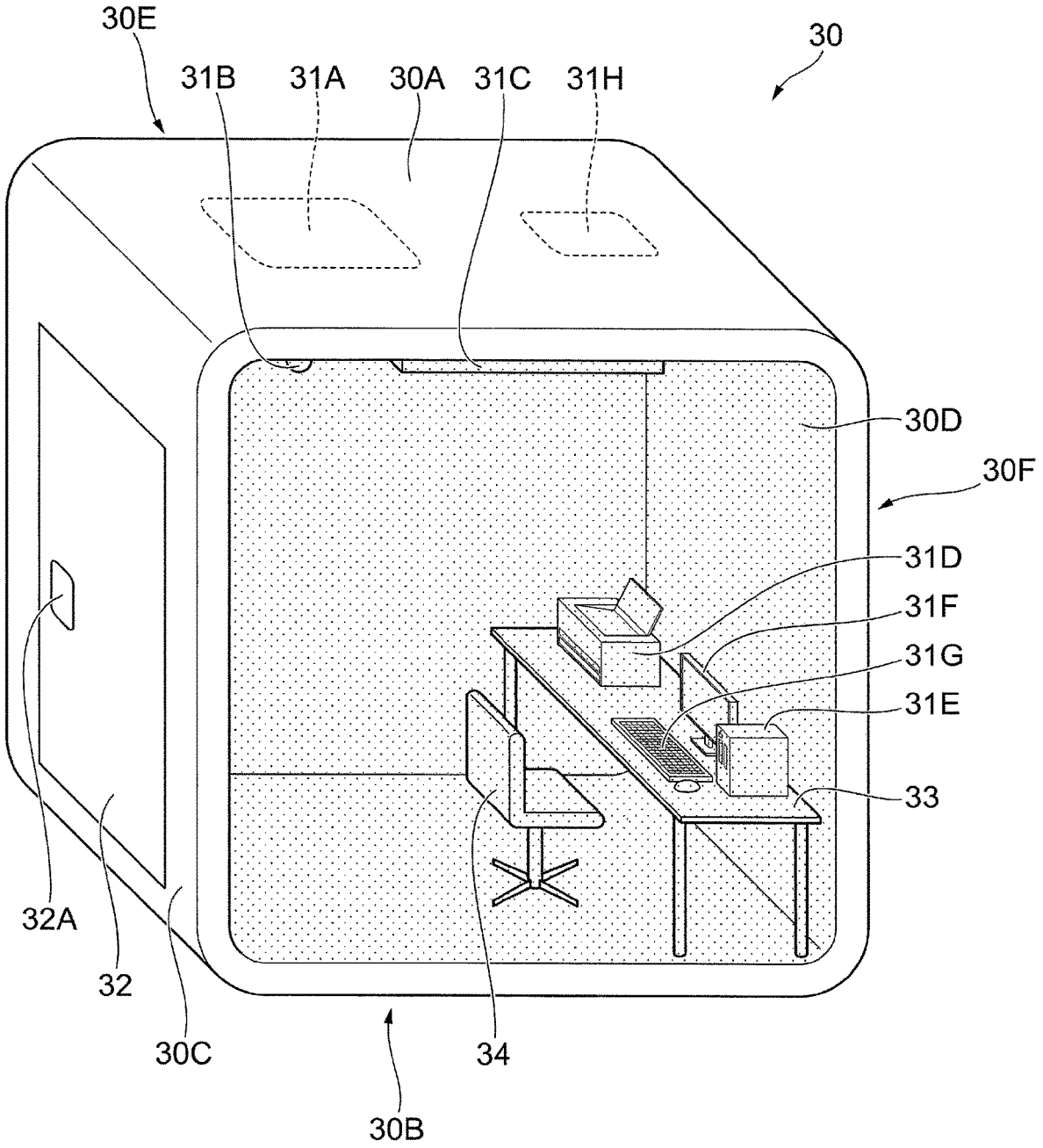
FIG. 2 is an external view of an example of the configuration of a space to be rented to a user.

FIG. 2 is an external view of an example of the configuration of a space 3 to be rented to a user.

In this exemplary embodiment, the spaces 3 are disposed indoors and outdoors, such as in station buildings, airports, office buildings, commercial complexes, for example, restaurants and department stores, banks, libraries, art galleries, museums, public institutions and facilities, passageways, and parks.

In this exemplary embodiment, a soundproof, small room is assumed as a space 3. In this sense, the space 3 is an example of a closed space. In this exemplary embodiment, however, "closed" does not mean "sealed", but is used in the sense of a space having a practical soundproof function. Openings and gaps, such as vent holes and small windows, may be provided in part of a skeleton 30 forming a space 3.

The skeleton 30 includes a ceiling 30A, a floor 30B, a wall 30C to which a door 32 is fixed, two walls 30D and 30E at both sides of the wall 30C, and a wall 30F opposite the door 32.

In this exemplary embodiment, a single hinged door is assumed as the door 32. In the single hinged door, a single door member is opened and closed such that it draws an arc. However, the door 32 may be a double hinged door having two door members.

The door 32 may be a sliding door. The sliding door may be a single sliding door in which one door member slides, a multiple sliding door set in which two or more door members slide in opposite directions on different rails, or a separate double sliding door set in which one door member slides to the left and the other door member slides to the right.

The door 32 may be a folding door in which a pair of door members connected by a hinge opens to fold back. The folding door has a single type which opens to one side and a double type which opens to two sides.

The door 32 may be a special door, such as a partition door or a pocket door which is withdrawn into a wall when it is not used.

The door 32 may be an inward opening type or an outward opening type.

In this exemplary embodiment, the walls 30D and 30E are partly constituted by a light-transmitting member, such as glass and acrylic resin, for example.

The structure, material, or processing to implement a blind function may be utilized for at least part of the walls 30D and 30E. The blind function makes it difficult to see the inside of the space 3 from the outside or to reduce the visibility through the walls 30D and 30E.

The material of the walls 30D and 30E may be a translucent member or a member with small scratches on its surface so as to cause light to scatter. A film-like member having a similar function may be attached to the walls 30D and 30E. The film-like member may be a liquid crystal film that can electrically switch between a transparent state and an opaque state or a polarizing film that can electrically control the luminous transmittance.

A structure or a member for a blind function may be provided separately. The walls 30D and 30E, as well as the other surfaces, may be made of a member that does not transmit light. Conversely, among the elements forming the skeleton 30, three or more surfaces may be made of a transparent or translucent member.

The number of users using a space 3 is largely determined by the volume of this space 3. Basically, in this exemplary embodiment, a private room for one person is assumed as a space 3. However, the space 3 may be a large room for accommodating a large group of people. A large room may be formed as one room, or it may be formed by interconnecting spaces 3 by removing one of or both of the walls 30D and 30E of each space 3.

A private room is not necessarily for only one person, and may be used for a few people, such as two or three people.

The configuration and structure of the skeleton 30 forming an individual space 3, and facilities to be provided by the space 3 and their performance may be determined as desired.

In this exemplary embodiment, one desk 33 and one chair 34 are disposed within the skeleton 30. On the desk 33, a printer 31D, a computer 31E, a display device 31F, and an input device 31G, which are examples of the devices 31, are placed. To protect user information, data and history information stored in the computer 31E are all deleted under the control of the system after the use of the space 3.

As the other devices 31, an air conditioner 31A, a human sensor 31B, a lighting fixture 31C used as indoor illumination, a control device 31H, and an authentication unit 32A are fixed. The control device 31H controls the operation of electronic devices including the devices 31.

The devices 31 are only examples of electronic devices. The printer 31D, the computer 31E, the display device 31F, and the input device 31G on the desk 33 may not necessarily be provided. In this case, a user uses its own computer or smartphone.

The entirety of the space 3 (including the skeleton 30) or the control device 31H is an example of an apparatus. The control device 31H is also an example of a controller.

Each of the user terminal 4, the reservation management server 5, the space management server 6, the billing management server 7, and the membership management server 8 is also an example of the apparatus.

The management system 1 is an example of a management system.

[Configuration of Terminal]

Examples of the configurations of the terminals forming the management system 1 will be discussed below with reference to FIGS. 3 through 5.

Figure 3:
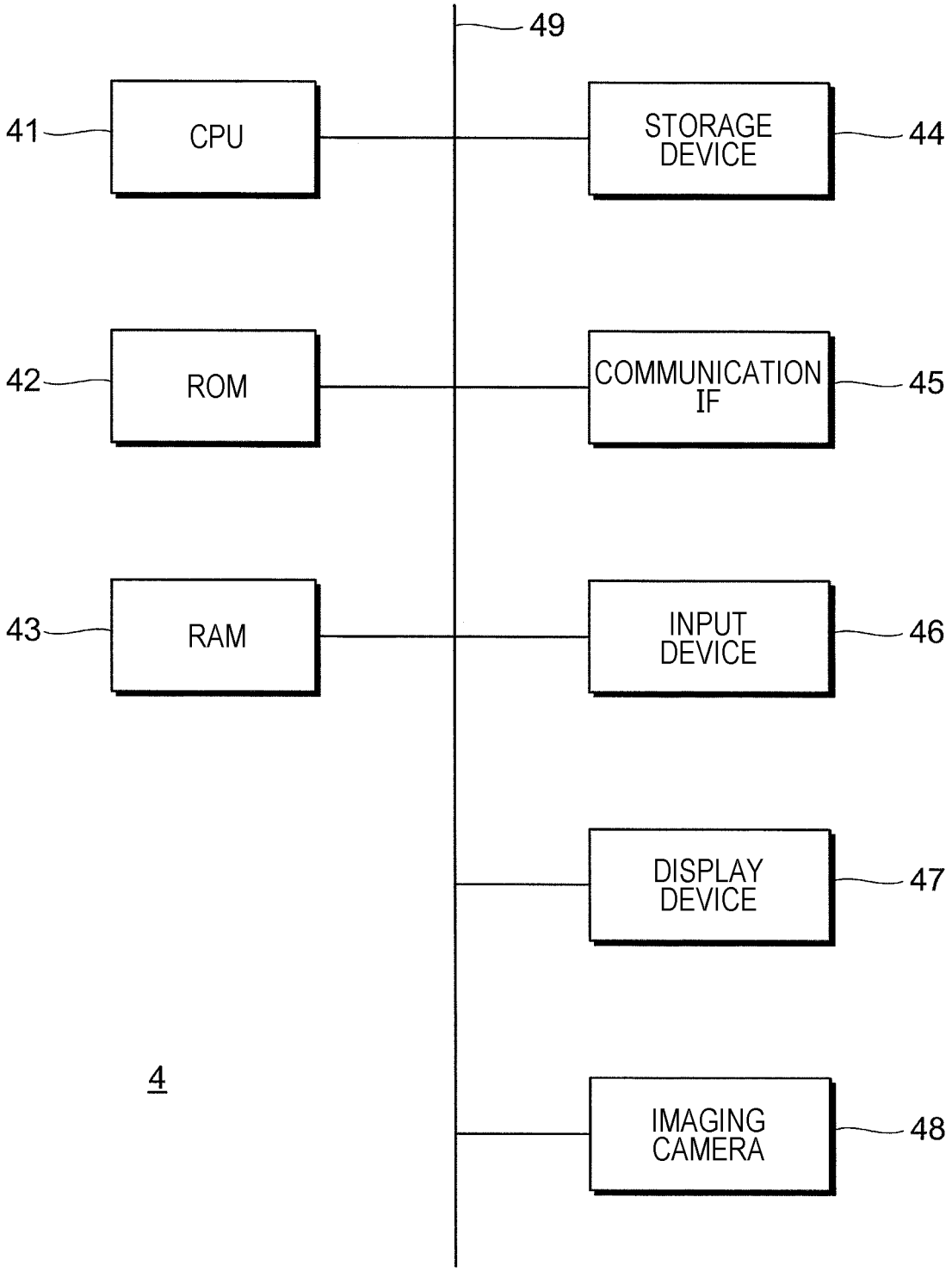
FIG. 3 is a block diagram illustrating an example of the hardware configuration of a user terminal.

FIG. 3 is a block diagram illustrating an example of the hardware configuration of the user terminal 4.

In this exemplary embodiment, a smartphone is used as the user terminal 4.

The user terminal 4 includes a central processing unit (CPU) 41, a read only memory (ROM) 42, and a random access memory (RAM) 43. The CPU 41 provides various functions by executing firmware and application programs. The ROM 42 is a storage area in which firmware and basic input output system (BIOS) are stored. The RAM 43 is an area where a program is executed.

The user terminal 4 also includes a volatile storage device 44, a communication interface 45 (communication IF), an input device 46, such as a touchscreen, a display device 47, and an imaging camera 48. The storage device 44, which is a semiconductor memory, for example, stores downloaded application programs and a digital key, for example. The communication IF 45 is used for communicating with external devices. The display device 47 is used for displaying information.

The CPU 41 is connected to the devices forming the user terminal 4 via a bus 49.

Figure 4:
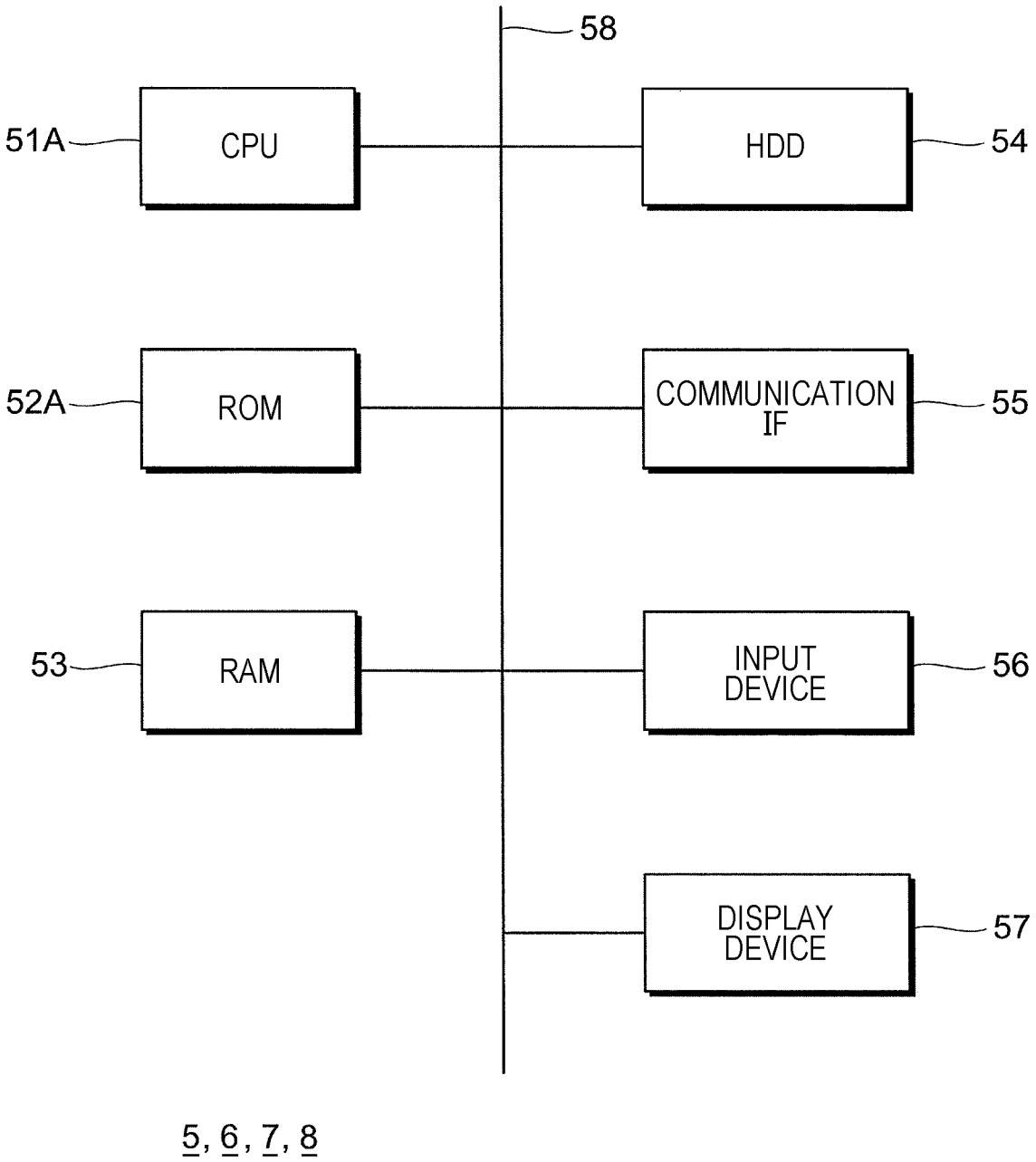
FIG. 4 is a block diagram illustrating an example of the hardware configuration of a server forming the management system.

FIG. 4 is a block diagram illustrating an example of the hardware configuration of a server forming the management system 1.

The configuration of the reservation management server 5 is shown in FIG. 4 as a typical example of the server. The configurations of the other servers, that is, the space management server 6, the billing management server 7, and the membership management server 8, are similar to the configuration of the reservation management server 5.

The reservation management server 5 includes a CPU 51A, a ROM 52A, and a RAM 53. The CPU 51A provides various management functions by executing an operating system (OS) and application programs. The ROM 52A is a storage area in which an OS and a BIOS are stored. The RAM 53 is an area where a program is executed.

The reservation management server 5 also includes a volatile hard disk drive (HDD) 54, a communication IF 55, an input device 56, such as a keyboard, and a display device 57. The HDD 54 stores application programs and various items of management data for implementing the associated management functions. The communication IF 55 is used for communicating with external devices. The display device 57 is used for displaying information.

The CPU 51A is connected to the devices via a bus 58.

Each server is an example of a database for storing management data.

Figure 5:
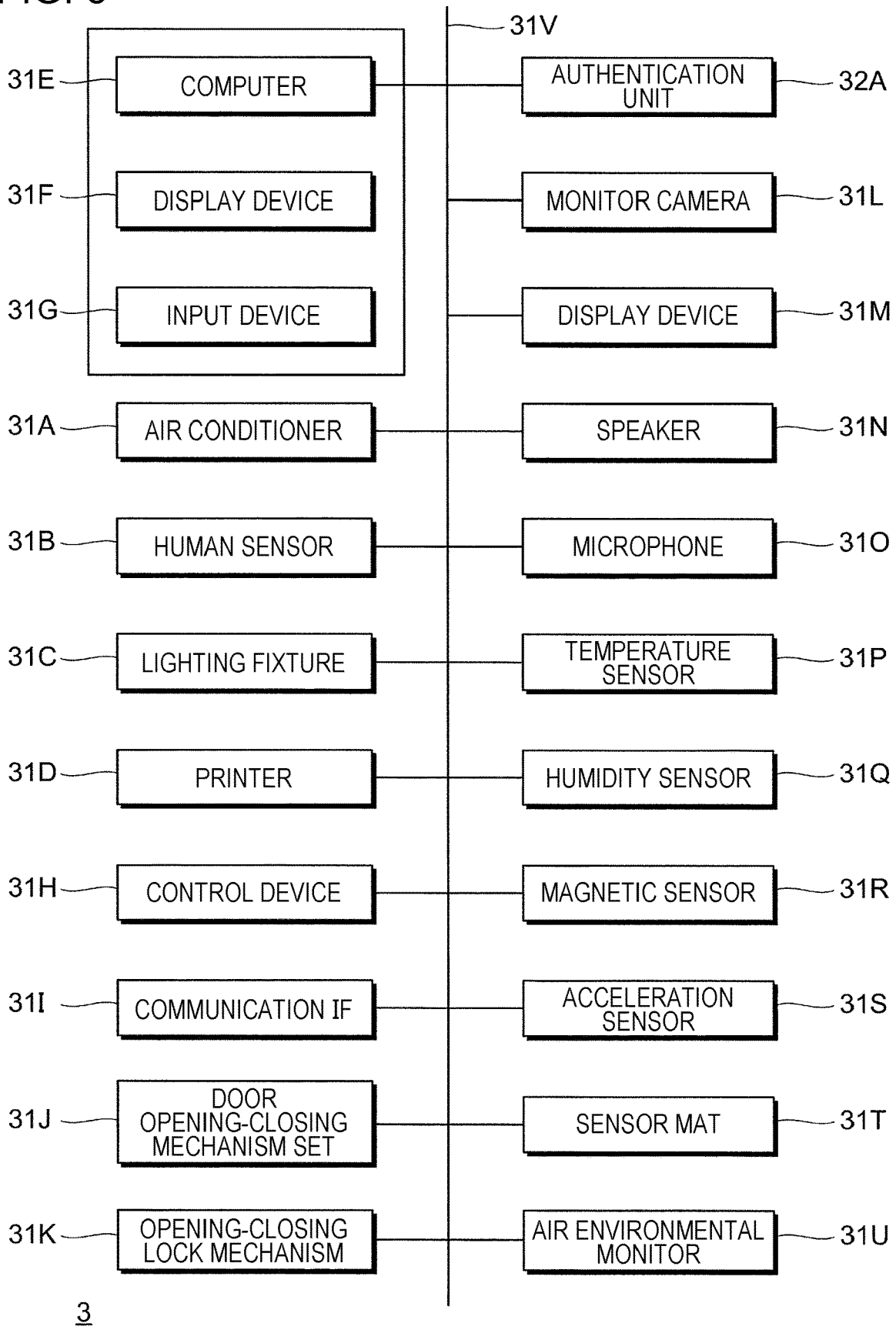
FIG. 5 is a block diagram illustrating an example of the configuration of a space which forms the management system.

FIG. 5 is a block diagram illustrating an example of the configuration of a space 3 which forms the management system 1.

The space 3 includes an air conditioner 31A, a human sensor 31B, a lighting fixture 31C, a printer 31D, a computer 31E, a display device 31F, an input device 31G, a control device 31H, and an authentication unit 32A.

The air conditioner 31A is used for adjusting the temperature and humidity within the space 3 (room). A mechanism specially used for ventilation may be provided, together with or separately from the air conditioner 31A.

The human sensor 31B is a sensor for detecting people within the space 3. As the human sensor 31B, various types of sensors, such as a pyroelectric infrared human sensor that can detect the motion of people, and an image human sensor and a thermopile human sensor that can detect the number and position of people, are available. One or plural of these types of sensors are used according to the purpose of use.

The printer 31D, the computer 31E, the display device 31F, and the input device 31G are examples of information devices installed in the room for a user to operate. These information devices are connected to each other via a local area network (LAN) 31V, such as a LAN cable or a wireless LAN. If a user brings its own computer, the computer is connected to the LAN 31V. As the wireless LAN, WiFi (registered trademark) or Bluetooth (registered trademark) is used.

The control device 31H is a control computer that collects information from the devices 31 connected to the LAN 31V and also controls the operations of the individual devices 31. In some management systems 1, the control device 31H provides the functions of the space management server 6.

The authentication unit 32A is fixed to the door 32 of the space 3, for example. The authentication unit 32A is used for obtaining and sending and receiving information required for locking and unlocking the door 32. Authentication is conducted in the reservation management server 5, and an authentication result is only supplied to the authentication unit 32A. When authentication has succeeded, the authentication unit 32A unlocks the door 32. After unlocking the door 32, a user can open and close the door 32 to enter the space 3 (see FIG. 2).

The space 3 also includes a communication IF 311 for communicating with external devices. The communication IF 311 is connected to the cloud network 2 (see FIG. 1) to communicate with various servers.

The space 3 also includes a door opening-closing mechanism set 31J for mechanically controlling the opening and closing of the door 32. The door opening-closing mechanism set 31J includes a mechanism for driving the door 32 to open and close and a mechanism for adjusting the magnitude of a load required for a user to open and close the door 32.

The space 3 also includes an opening-closing lock mechanism 31K. The opening-closing lock mechanism 31K temporarily stops the opening and closing of the door 32. While the opening-closing lock mechanism 31K is in operation, at least the operation of closing the door 32 is temporarily stopped.

The space 3 also includes a monitor camera 31L for monitoring the motion of users indoors and outdoors. However, the monitor camera 31L may not necessarily be provided.

The space 3 also includes a display device 31M. In this exemplary embodiment, the display device 31M is disposed on the external side of the wall 30C to which the door 32 is fixed, and is used for a user to operate when entering the space 3 and also for providing information. The display device 31M is also used for a user using the space 3 and also for providing information.

The space 3 also includes a speaker 31N. The speaker 31N is used for supplying information to a user indoors and to people outdoors. The speaker 31N is an example of an informing unit.

The space 3 also includes a microphone 310. The microphone 310 is used for collecting indoor sound.

The space 3 also includes a temperature sensor 31P. The temperature sensor 31P is used for measuring the indoor temperature.

The space 3 also includes a humidity sensor 31Q. The humidity sensor 31Q is used for measuring the indoor humidity.

The space 3 also includes a magnetic sensor 31R. The magnetic sensor 31R is attached to the door 32 to detect the opening or closing of the door 32 by sensing a magnetic force.

The space 3 also includes an acceleration sensor 31S. The acceleration sensor 31S is used for detecting the motion of an object.

The space 3 also includes a sensor mat 31T. The sensor mat 31T detects the weight of an object to visualize the time period for which a user has stayed in the space 3 or the congestion status of the space 3.

The space 3 also includes an air environmental monitor 31U. The air environmental monitor 31U, which detects constituents contained in air in the space 3, measures concentrations of PM2.5 and PM10, carbon dioxide, and volatile organic compounds. The air environmental monitor 31U may also measure the temperature and the humidity. The air environmental monitor 31U may not necessarily measure all of the above-described constituents or may measure other constituents. If the air environmental monitor 31U measures the temperature and the humidity, the provision of the temperature sensor 31P and the humidity sensor 31Q may be omitted.

[Control Function]

A control function implemented by one of the terminals forming the management system 1 (see FIG. 1) or by collaborative work of some of the terminals will be discussed below with reference to FIG. 6.

A description will be given of a case in which the control function is implemented by the control device 31H alone.

Figure 6:
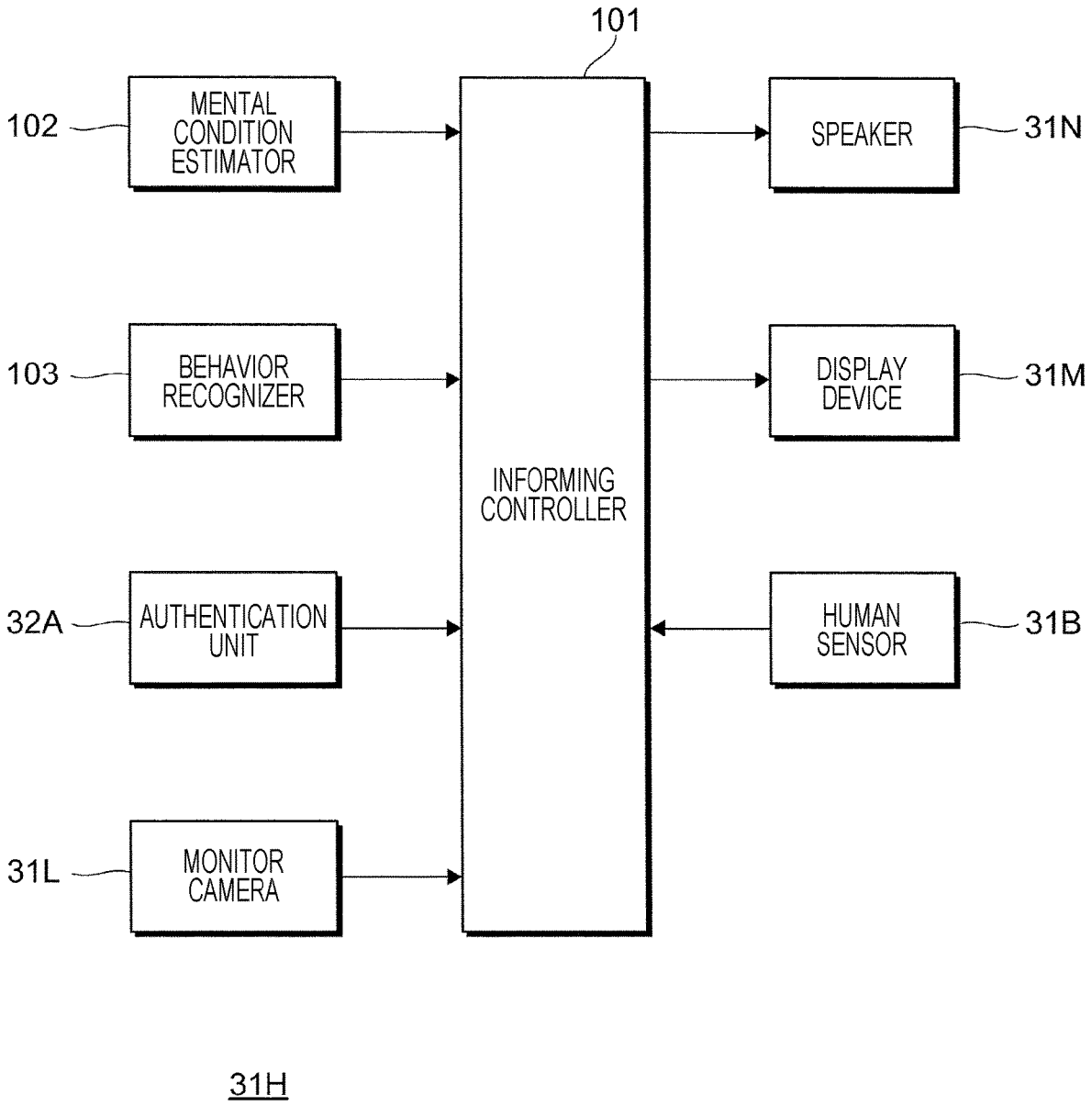
FIG. 6 is a block diagram illustrating an example of the software configuration of a control device.

FIG. 6 is a block diagram illustrating an example of the software configuration of the control device 31H.

The control device 31H implements the corresponding functions by executing a program.

The control device 31H includes an informing controller 101, a mental condition estimator 102, and a behavior recognizer 103. The informing controller 101 controls the provision of information to each of a person inside a space 3 and that outside the door 3 about the presence of the other person. The mental condition estimator 102 estimates the mental condition of each of a person inside space 3 and that outside the space 3. The behavior recognizer 103 recognizes the behavior of each of a person inside a space 3 and that outside the space 3.

The mental condition estimator 102 may estimate the mental condition of only one of a person indoors and that outdoors. The behavior recognizer 103 may recognize the behavior of each of a person indoors and that outdoors.

The mental condition estimator 102 estimates the mental condition of a person by analyzing imaging data output from the monitor camera 31L, for example. The behavior recognizer 103 recognizes the current behavior of a person by analyzing imaging data output from the monitor camera 31L, for example.

The informing controller 101 is an example of a controller. The informing controller 101 identifies the presence of a person by using the human sensor 31B or the monitor camera 31L. The informing controller 101 controls the informing operation by using the speaker 31N or the display device 31M, based on the estimation results of the mental condition estimator 102, the recognition results of the behavior recognizer 103, and the authentication results of the authentication unit 32A. Specific examples of the control operation will be discussed later.

Each of the speaker 31N and the display device 31M is an example of an informing unit.

[Examples of Control Operation]

Examples of the control operation implemented under the control of the informing controller 101 (see FIG. 6) will be described below.

First Example

A first example of the control operation executed by the informing controller 101 will be discussed below with reference to FIGS. 7 through 9C.

Figure 7:
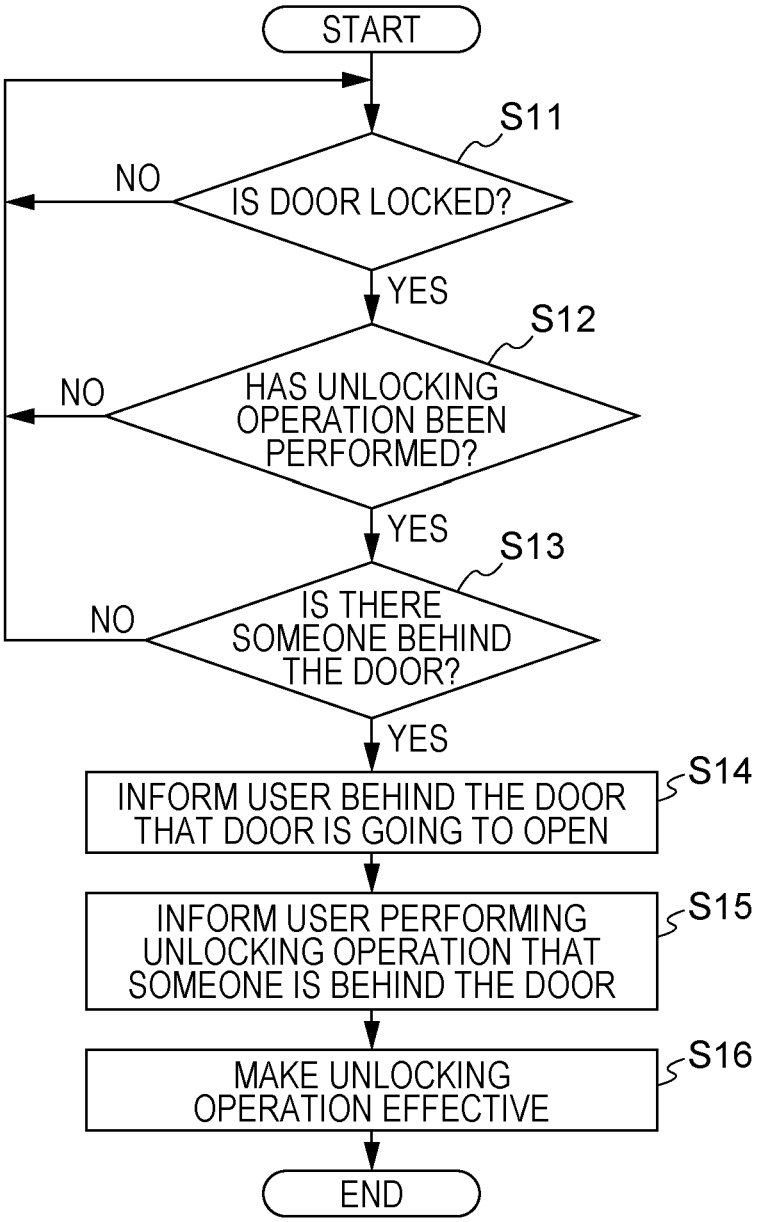
FIG. 7 is a flowchart illustrating an example of a control operation executed by an informing controller according to a first example.

FIG. 7 is a flowchart illustrating an example of the control operation executed by the informing controller 101 according to the first example.

Figure 8A:
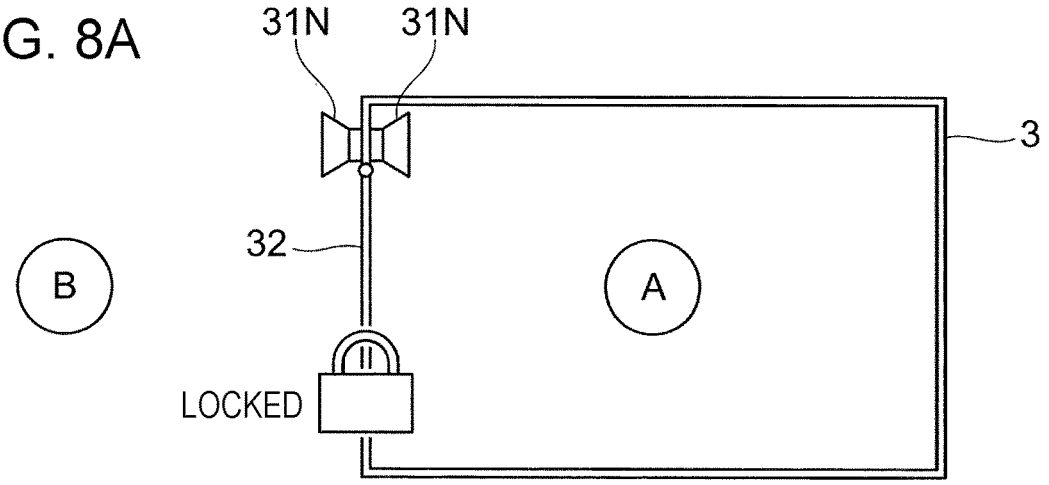
FIGS. 8A through 8C illustrate a control process when the unlocking operation is performed from indoors.
Figure 8B:
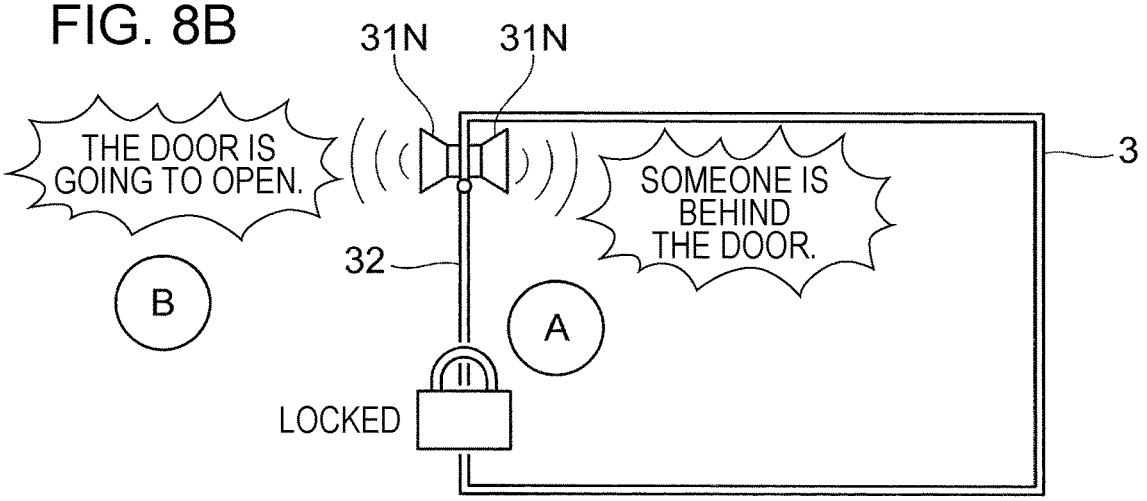
Figure 8C:
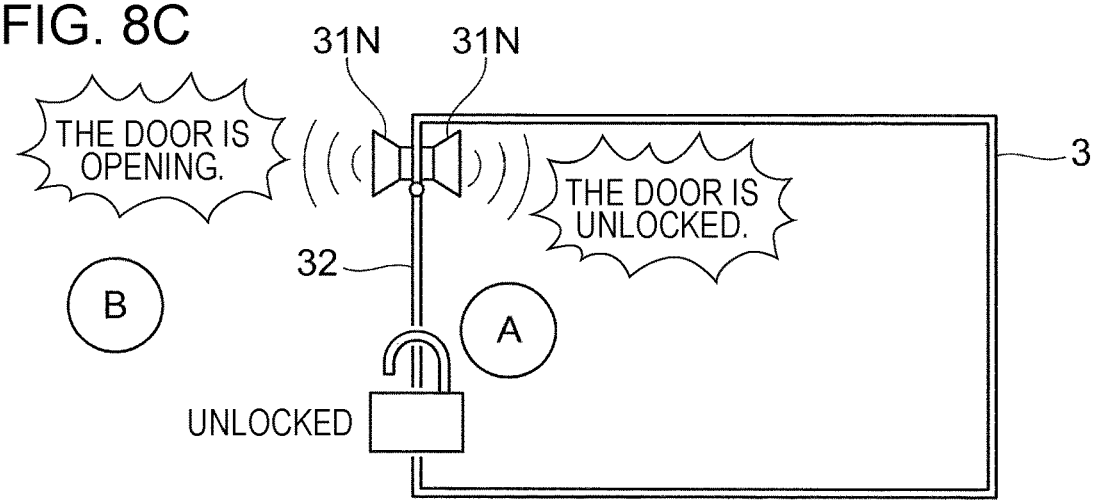

FIGS. 8A through 8C illustrate a control process when the unlocking operation is performed from indoors. FIG. 8A shows a state in which user A is indoors and user B is outdoors. FIG. 8B shows a state in which user A performs the unlocking operation inside a space 3. FIG. 8C shows a state in which the unlocking operation is made effective.

Figure 9A:
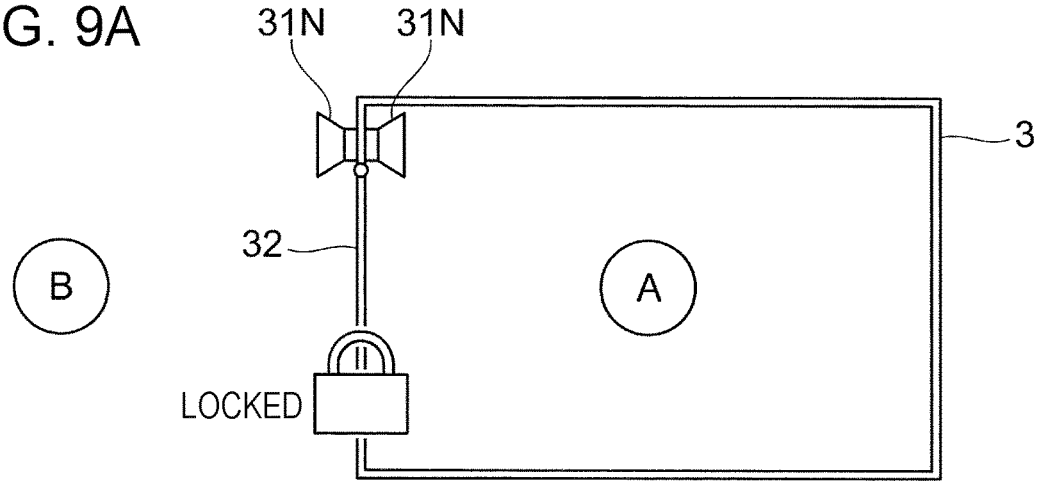
FIGS. 9A through 9C illustrate a control process when the unlocking operation is performed from outdoors.
Figure 9B:
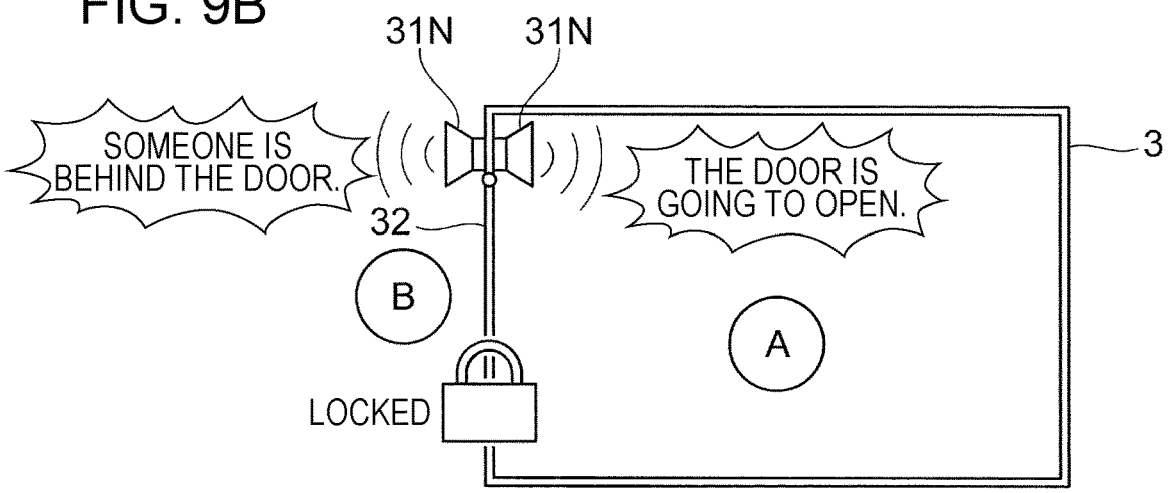
Figure 9C:
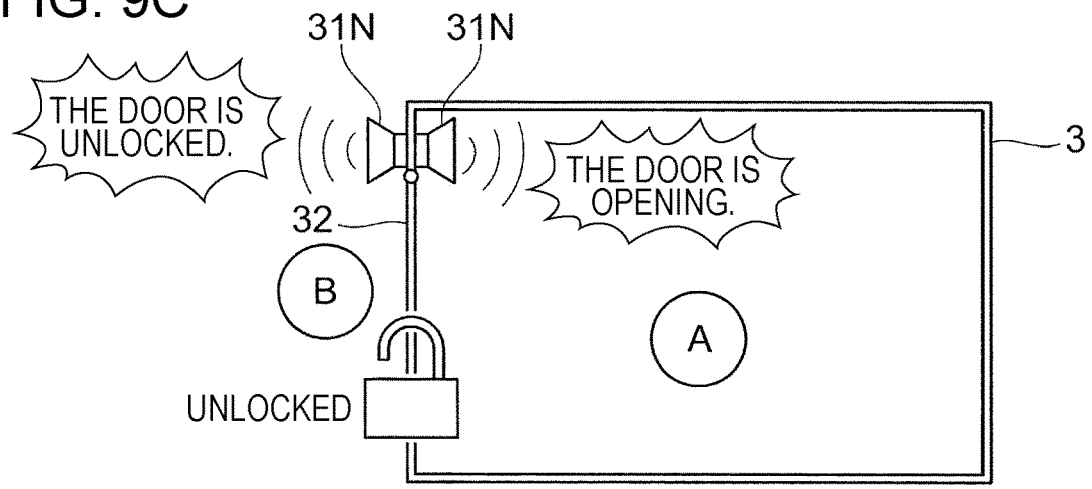

FIGS. 9A through 9C illustrate a control process when the unlocking operation is performed from outdoors. FIG. 9A shows a state in which user A is indoors and user B is outdoors. FIG. 9B shows a state in which user B performs the unlocking operation outside a space 3. FIG. 9C shows a state in which the unlocking operation is made effective.

Referring back to FIG. 7, the informing controller 101 judges in step S11 whether the door 32 is locked. The informing controller 101 executes S11 regardless of whether a user is indoors. There may be a case in which the user leaves the space 3 for eating or going to the bathroom during a reserved time period.

While the result of step S11 is NO, the informing controller 101 repeats step S11.

If the result of step S11 is YES, the informing controller 101 judges in step S12 whether an unlocking operation has been performed.

The informing controller 101 executes step S12 regardless of whether a user is indoors. The unlocking operation may be performed either from inside a space 3 or outside the space 3.

The unlocking operation is an example of an operation to set a door in a state in which the door will be opened. The unlocking operation may include a certain action suggesting that the unlocking operation will be performed, such as a gesture of taking out a key or placing the user terminal 4 in front of the authentication unit 32A. The informing controller 101 may use imaging data output from the monitor camera 31L, for example, to judge whether the unlocking operation has been performed.

If the result of step S12 is NO, the informing controller 101 returns to step S11.

If the result of step S12 is YES, the informing controller 101 judges in step S13 whether someone is behind the door 32.

If the unlocking operation has been performed from outdoors, the informing controller 101 judges whether someone is indoors by using information output from the human sensor 31B or the monitor camera 31L installed indoors.

If the unlocking operation has been performed from indoors, the informing controller 101 judges whether someone is outdoors, such as a passerby or a user to use the space 3 next time, by using information output from the human sensor 31B or the monitor camera 31L installed outdoors.

If the result of step S13 is NO, there is no chance that user A indoors and user B outdoors, such as those shown in FIG. 8A or 9A, will face each other. The informing controller 101 thus returns to step S11.

If the result of step S13 is YES, the process proceeds to step S14. In step S14, the informing controller 101 informs the user behind the door 32 that the door 32 is going to open by using the display device 31M (see FIG. 6) or the speaker 31N (see FIG. 6).

Then, in step S15, the informing controller 101 informs the user performing the unlocking operation that someone is behind the door 32 by using the display device 31M or the speaker 31N.

In the example in FIG. 7, the informing controller 101 provides the above-described information to a person behind the door 32 first and then provides the information to the person performing the unlocking operation. However, the order may be reversed. The informing controller 101 may alternatively provide the information to people on both sides at the same time. At this stage, the door 32 is still locked.

Then, in step S16, the informing controller 101 makes the unlocking operation effective. Thereafter, the door 32 can be opened. In this manner, the unlocking operation is made effective after the informing controller 101 has provided the information. This allows the users on both sides to prepare for the appearance of another person.

The door 32 can be opened either from indoors or from outdoors.

A description will first be given of a case in which the unlocking operation is performed from indoors. In one example of such a case, user A unlocks the door 32 and leaves the space 3. Leaving the space 3 also means that user A temporarily leaves the space 3 for shopping or going to the bathroom.

As shown in FIG. 8A, in the state in which the door 32 is locked, user A performs the unlocking operation from indoors. Then, a warning "Someone is behind the door." is provided to user A indoors, and a warning "The door is going to open." is provided to user B outdoors, as shown in FIG. 8B.

Then, as shown in FIG. 8C, the door 32 is unlocked and user A can open the door 32 to leave the space 3. In this case, user A is informed of a change of the state "The door is unlocked.", and a warning "The door is opening." is provided to user B.

At this time point, both of user A and user B know that someone is behind the door 32. Not only user A opening the door 32, but also user B outside the space 3, can expect the presence of someone before the door 32 opens and is not startled by the sudden appearance.

There may be a case in which the unlocking operation is performed from outdoors. In one example of such a case, both of user A and user B have registered a space 3 for the same time period, but user A has arrived the space 3 earlier and user B enters the space 3 later. In another example, user B has reserved a space 3 for a time period immediately after user A, and when a reserved time of user B has reached (or when user B has entered the space 3 earlier), user A has not yet left the space 3.

In this case, when user B has performed the unlocking operation from outdoors, as shown in FIG. 9A, a warning "The door is going to open." is provided to user A, and a warning "Someone is behind the door." is provided to user B, as shown in FIG. 9B.

Then, user B is informed of a change of the state "The door is unlocked.", and a warning "The door is opening." is provided to user A, as shown in FIG. 9C.

The above-described informing function is effective particularly when a user is in an enclosed space. For example, when the desk 33 is located against the wall 30F opposite the door 32, as shown in FIG. 2, user A at the desk 33 faces the direction opposite the door 32 and is almost unaware that someone is entering the space 3, and much less, when user A is concentrating on its work.

Informing user A that the door 32 is going to open gives user A some time to prepare for the presence of user B before the door 32 is actually opened.

In this example, the informing controller 101 provides information upon detecting that the unlocking operation has been performed. This allows a user behind the door 32 to have more time before facing another user than when the informing controller 101 provides information upon detecting that the door 32 is actually opening.

Second Example

A second example of the control operation executed by the informing controller 101 will be discussed below with reference to FIGS. 10 through 11C.

Figure 10:
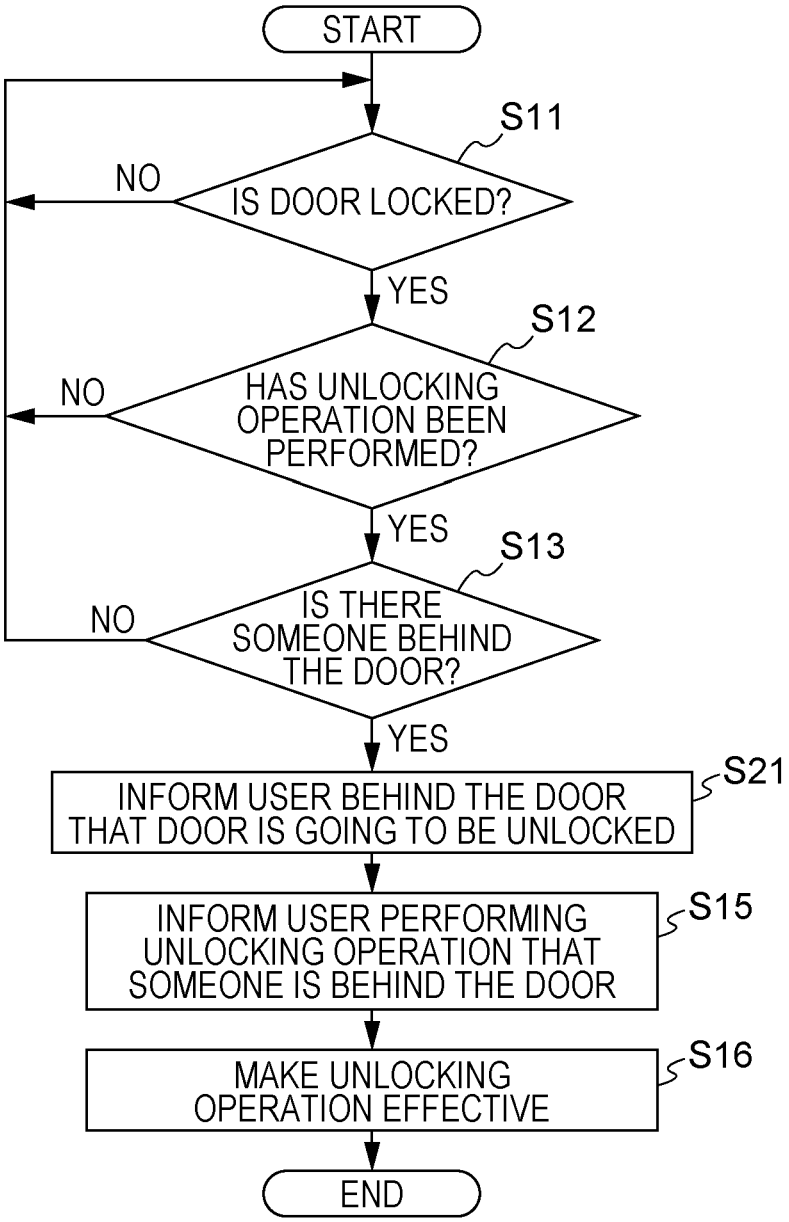
FIG. 10 is a flowchart illustrating an example of a control operation executed by the informing controller according to a second example.

FIG. 10 is a flowchart illustrating an example of the control operation executed by the informing controller 101 according to the second example. In FIG. 10, steps corresponding to those shown in FIG. 7 are designated by like step numbers.

Figure 11A:
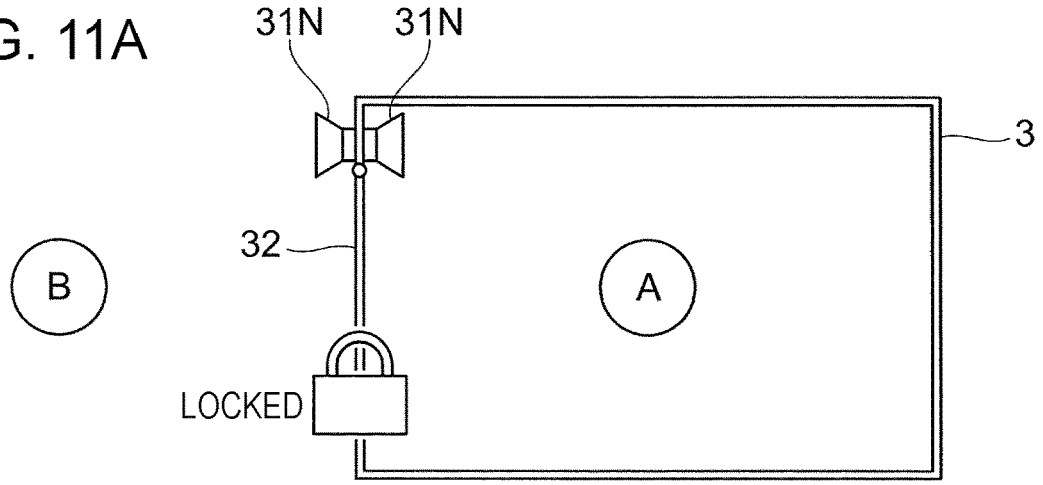
FIGS. 11A through 11C illustrate a control process when the unlocking operation is performed from outdoors.
Figure 11B:
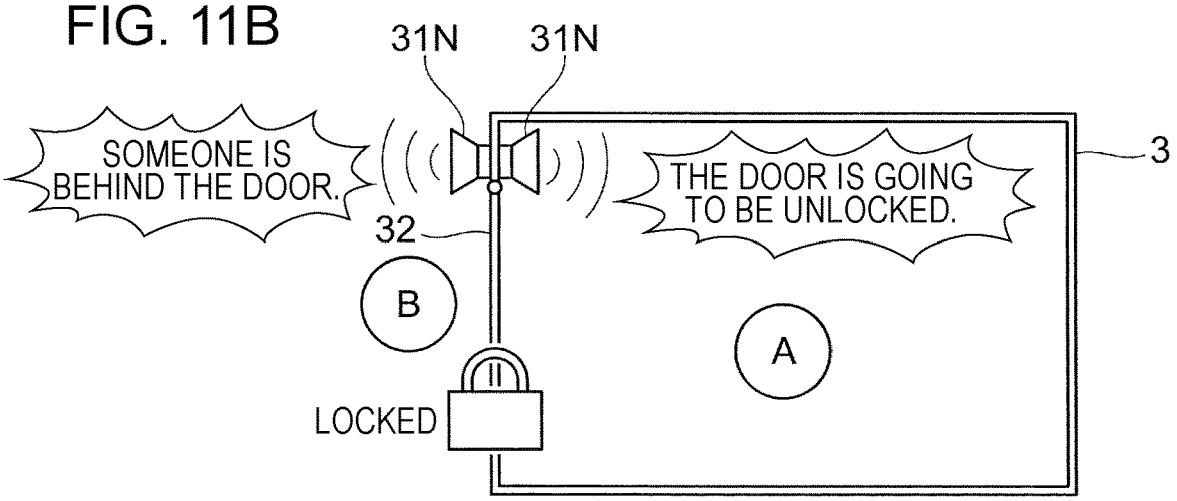
Figure 11C:
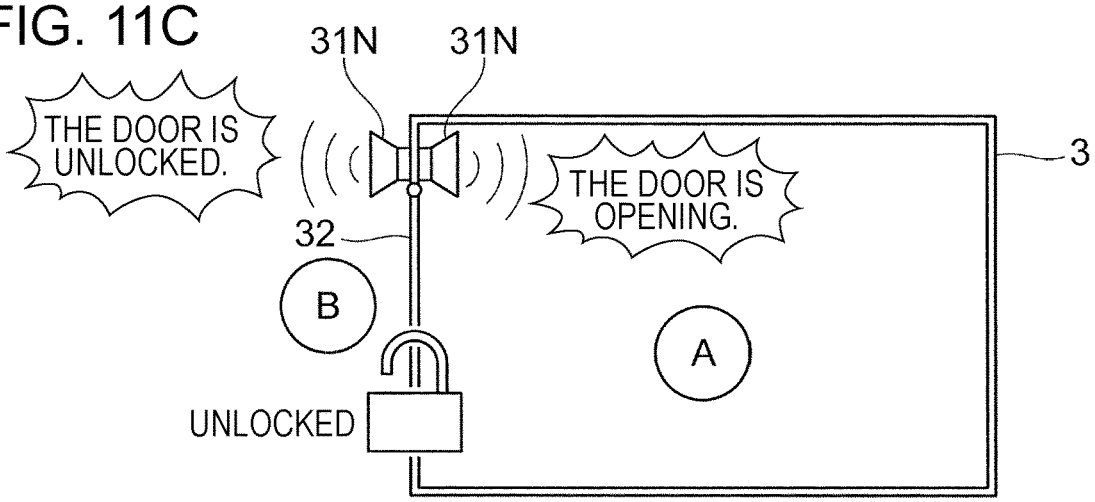

FIGS. 11A through 11C illustrate a control process when the unlocking operation is performed from outdoors. FIG. 11A shows a state in which user A is indoors and user B is outdoors. FIG. 11B shows a state in which user B performs the unlocking operation outside a space 3. FIG. 11C shows a state in which the unlocking operation is made effective.

As in the first example, the informing controller 101 first judges in step S11 whether the door 32 is locked.

While the result of step S11 is NO, the informing controller 101 repeats step S11.

If the result of step S11 is YES, the informing controller 101 judges in step S12 whether an unlocking operation has been performed. If the result of step S12 is NO, the informing controller 101 returns to step S11.

If the result of step S12 is YES, the informing controller 101 judges in step S13 whether someone is behind the door 32.

If the result of step S13 is NO, the informing controller 101 returns to step S11.

If the result of step S13 is YES, the process proceeds to step S21. In step S21, the informing controller 101 informs the user behind the door 32 that the door 32 is going to be unlocked by using the display device 31M (see FIG. 6) or the speaker 31N (see FIG. 6). FIG. 11B shows the state in step S21.

Then, in step S15, the informing controller 101 informs the user performing the unlocking operation that someone is behind the door 32 by using the display device 31M or the speaker 31N. Then, in step S16, the informing controller 101 makes the unlocking operation effective.

In the example in FIGS. 11A through 11C, the unlocking operation is performed from outdoors. The control operation is similarly executed when the unlocking operation is performed from indoors. This control operation seems to be more effective when informing someone indoors that the unlocking operation is going to be performed than informing someone outdoors.

Third Example

A third example of the control operation executed by the informing controller 101 will be discussed below with reference to FIG. 12.

Figure 12:
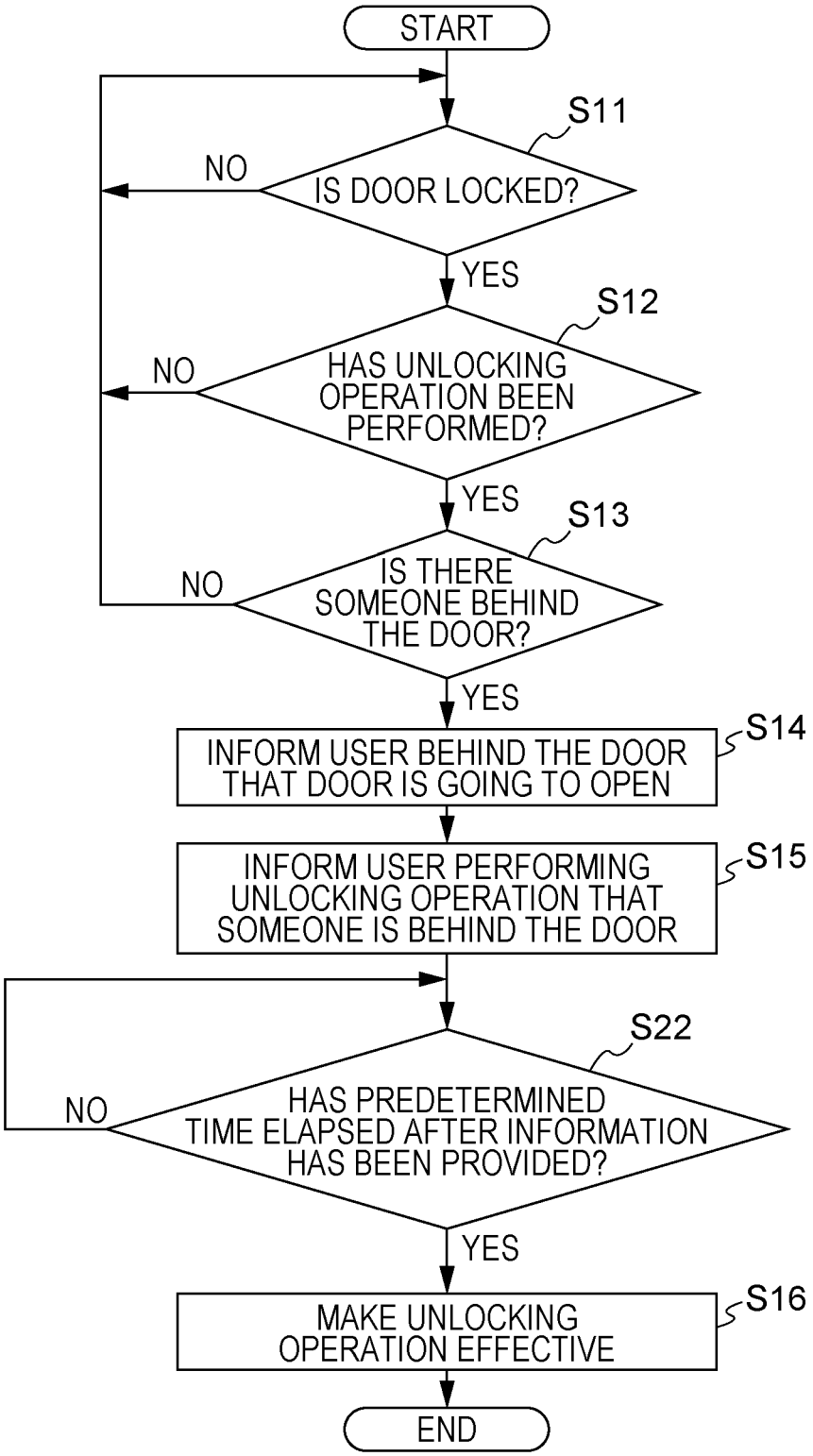
FIG. 12 is a flowchart illustrating an example of a control operation executed by the informing controller according to a third example.

FIG. 12 is a flowchart illustrating an example of the control operation executed by the informing controller 101 according to the third example. In FIG. 12, steps corresponding to those shown in FIG. 7 are designated by like step numbers.

The third example is different from the first example in that step S22 is inserted between step S15 and S16 to judge whether a predetermined time has elapsed after providing information to users.

Until the predetermined time has elapsed, the result of step S22 becomes NO, that is, step S22 is repeated. It is thus possible to secure the predetermined time, for example, ten seconds, before step S22 becomes YES and the unlocking operation is made effective.

In the above-described first and second examples, although a warning is given before the door 32 is opened, if the unlocking operation is made effective immediately, the door 32 may open almost at the same time with the provision of a warning. This makes the informing function less effective.

In the third example, however, after the unlocking operation is performed, the predetermined time is given before this operation is made effective. This allows a user to have some time after being aware of the presence of someone behind the door 32 and before facing this person. The user may also be able to make various preparations by using this time.

Fourth Example

A fourth example of the control operation executed by the informing controller 101 will be discussed below with reference to FIGS. 13 through 14C.

Figure 13:
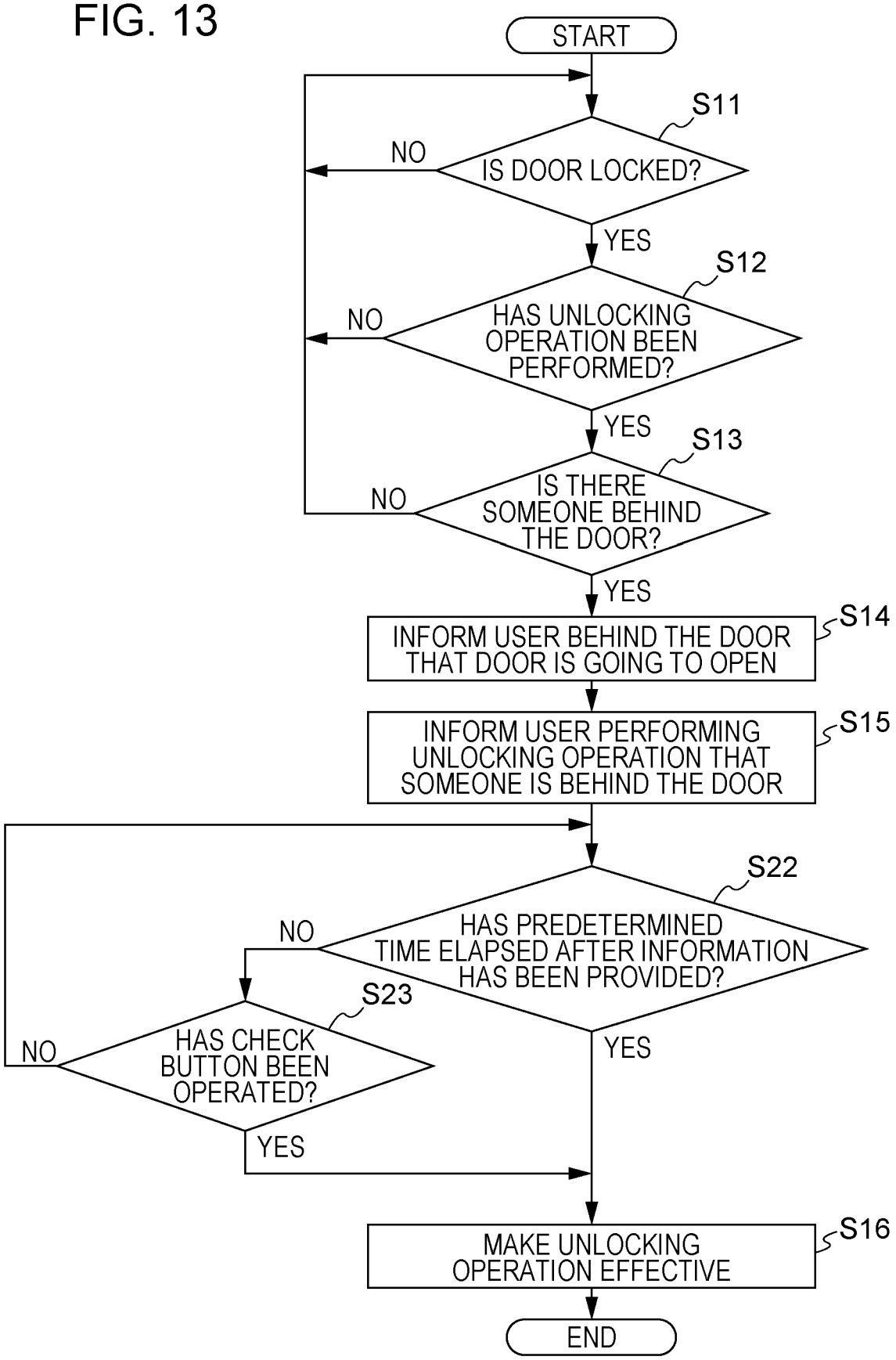
FIG. 13 is a flowchart illustrating an example of a control operation executed by the informing controller according to a fourth example.

FIG. 13 is a flowchart illustrating an example of the control operation executed by the informing controller 101 according to the fourth example. In FIG. 13, steps corresponding to those shown in FIG. 7 are designated by like step numbers.

Figure 14A:
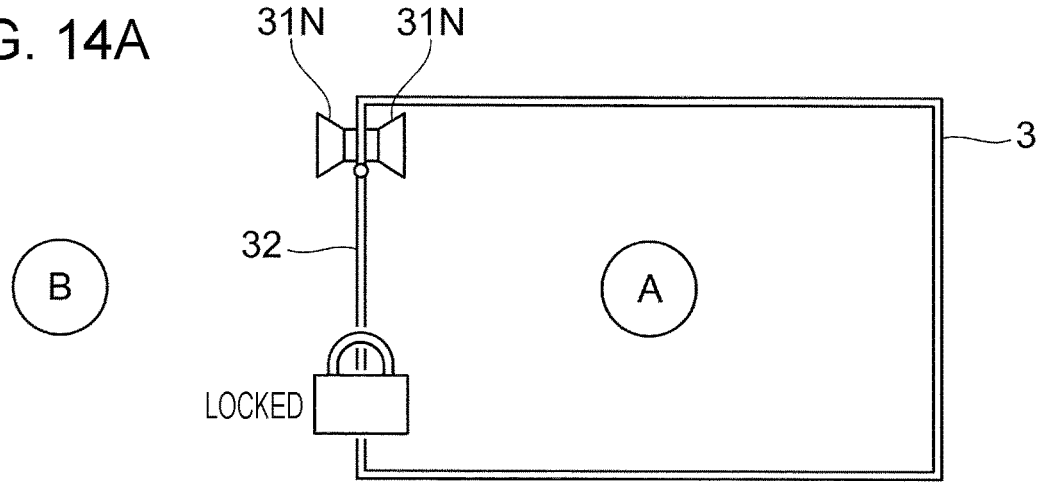
FIGS. 14A through 14C illustrate a control process when the unlocking operation is performed from outdoors.
Figure 14B:
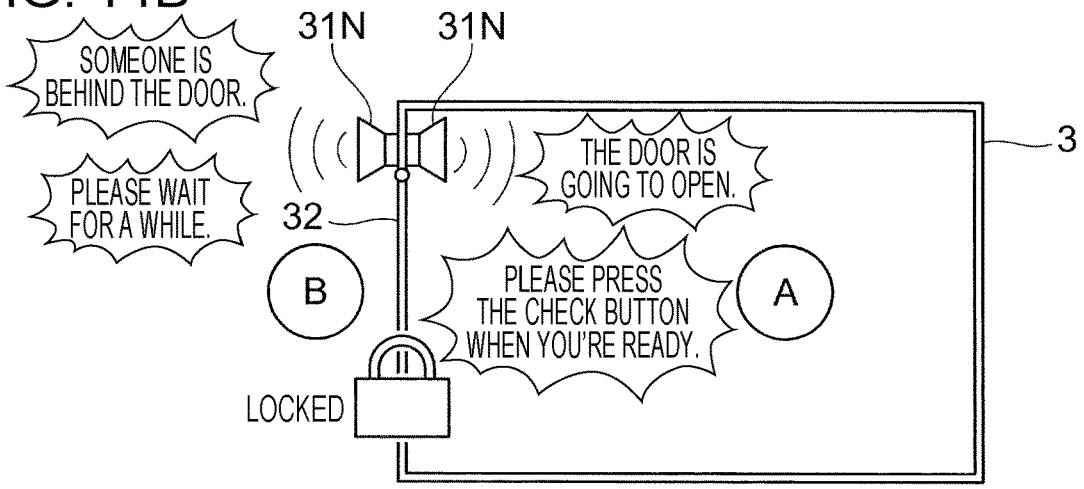
Figure 14C:
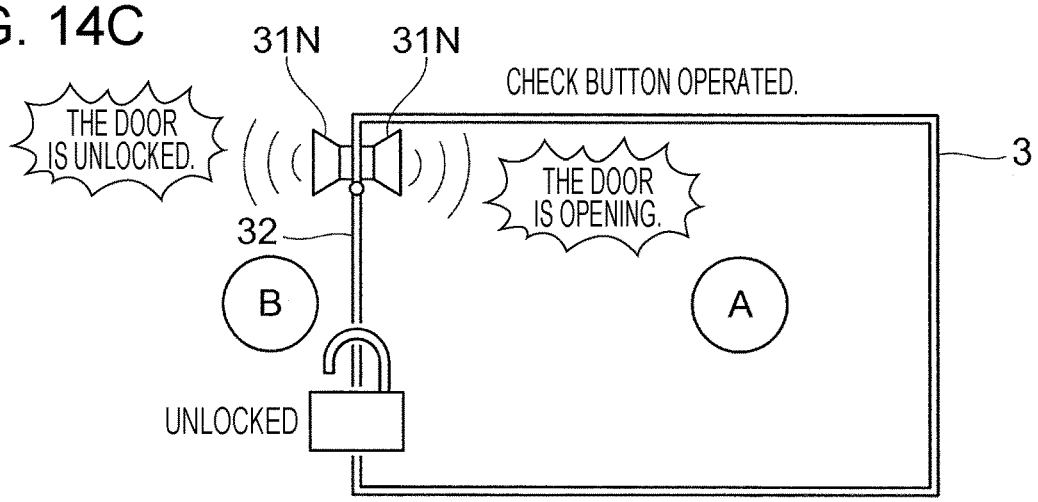

FIGS. 14A through 14C illustrate a control process when the unlocking operation is performed from outdoors. FIG. 14A shows a state in which user A is indoors and user B is outdoors. FIG. 14B shows a state in which user B performs the unlocking operation outside a space 3. FIG. 14C shows a state in which the unlocking operation is made effective.

In the above-described third example, to allow a user to prepare for the appearance of another person behind the door 32, the predetermined time is secured after information is given to this user before the unlocking operation is made effective. If this time is too short, the user fails to prepare for facing another person behind the door 32 in time. Hence, a long time may be set as the predetermined time.

However, if the user is ready, it does not have to wait for the predetermined time to elapse.

In the fourth example, if it is found in step S22 that the predetermined time has not elapsed yet (NO in step S22), the informing controller 101 judges in step S23 whether the user has checked the information provided in step S14. More specifically, the informing controller 101 judges in step S23 whether the user has operated a check button (not shown).

In the fourth example of the control operation, when providing information in steps S14 and S15, the user indoors and the user outdoors are also instructed to perform certain operation and action.

In the example in FIG. 14B, not only a warning "The door is going to open." to user A, but also an instruction "Please press the check button when you're ready." is provided to user A.

For user B performing the unlocking operation, not only a warning "Someone is behind the door.", but also an instruction "Please wait for a while." is provided.

After steps S14 and S15, the informing controller 101 executes step S22, and if step S22 is NO, the informing controller 101 executes step S23. If the result of step S23 is NO, it means that user A is not ready yet, and the informing controller returns to step S22. Unless user A presses the check button, the unlocking operation is not made effective until the predetermined time elapses.

If the result of step S23 is YES, the informing controller 101 can proceed to step S16 even before the predetermined time elapses. For example, as shown in FIG. 14C, information "The door is unlocked." is provided to instruct user B to enter the space 3, while a warning "The door is opening." is given to inform user A of the appearance of another person.

In the fourth example, it is possible to secure the predetermined time to let user B wait and user A behind the door 32 get ready.

The fourth example may be modified such that the unlocking operation is not made effective until the user operates the check button. In this setting, however, the door 32 may never be unlocked unless the check button is operated. Certain measures may desirably be taken for such a case.

A button for extending the time before the unlocking operation is made effective may be provided. If the user finds it hard to get ready before the unlocking operation is made effective, it operates this button to extend the time. The user may be able to extend the time every time it operates the button. Alternatively, the user may be allowed to extend the time only a limited number of times. The user may be able to select the extendable time from several options since the time required to get ready varies depending on the user.

Fifth Example

A fifth example of the control operation executed by the informing controller 101 will be discussed below with reference to FIGS. 15 through 16B.

Figure 15:
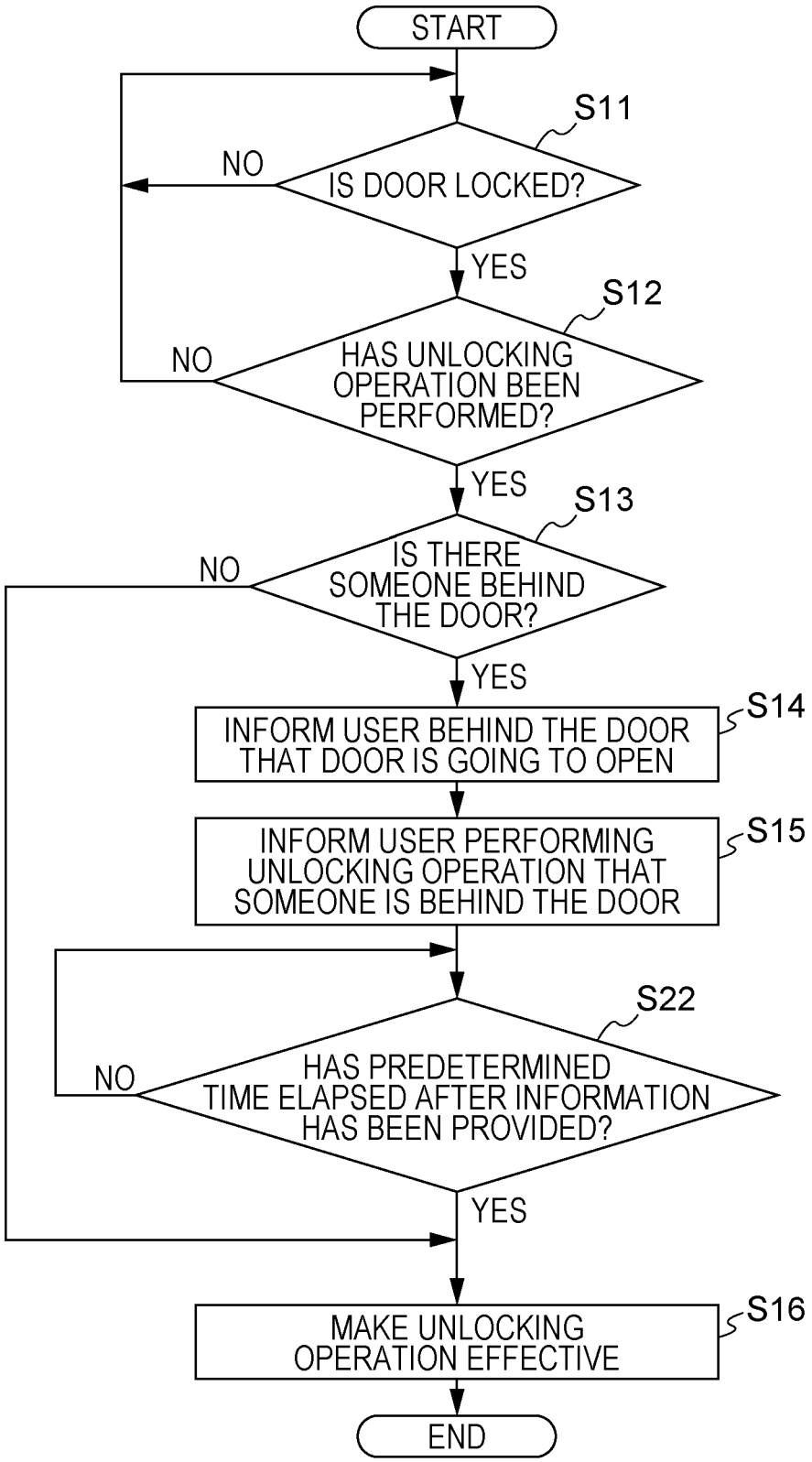
FIG. 15 is a flowchart illustrating an example of a control operation executed by the informing controller according to a fifth example.

FIG. 15 is a flowchart illustrating an example of the control operation executed by the informing controller 101 according to the fifth example. In FIG. 15, steps corresponding to those shown in FIG. 12 are designated by like step numbers.

Figure 16A:
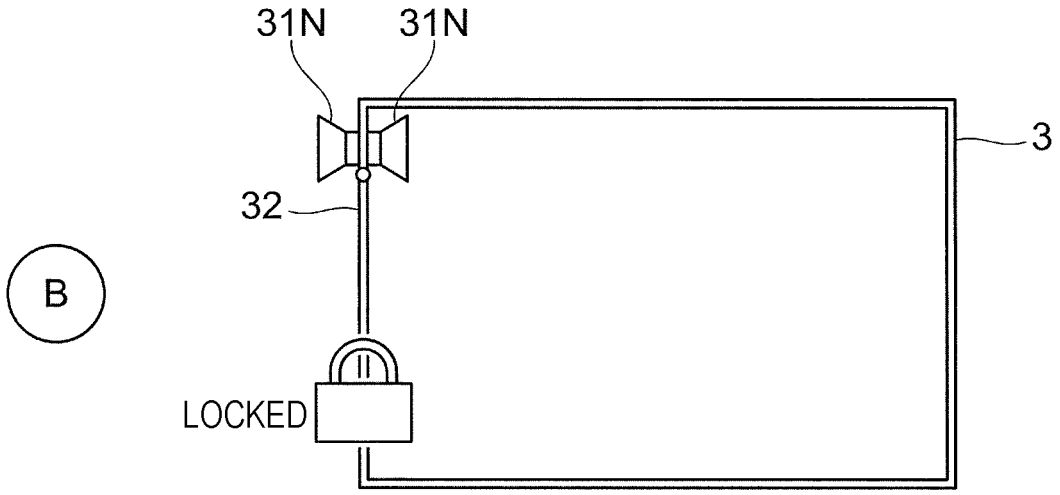
FIGS. 16A and 16B illustrate a control process when the unlocking operation is performed from outdoors.
Figure 16B:
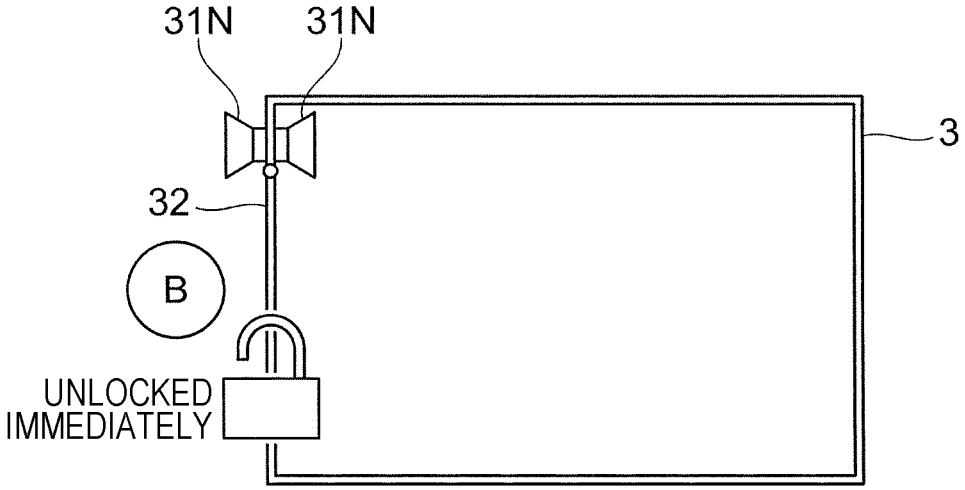

FIGS. 16A and 16B illustrate a control process when the unlocking operation is performed from outdoors. FIG. 16A shows a state in which nobody is in the space 3. FIG. 16B shows a state in which user B performs the unlocking operation outside the space 3.

In the above-described first through fourth examples, when a user enters or leaves a space 3, it is informed of the presence of another person behind the door 32. However, if nobody is behind the door 32, it is better to let the user enter or leave the space 3 freely.

In the fifth example of the control operation, if it is found in step S13 that nobody is behind the door 32 (NO in step S13), the process proceeds to step S16 instead of returning to step S11. FIGS. 16A and 16B illustrate a control process in a case in which the result of step S13 is NO. As shown in FIG. 16A, user B performs the unlocking operation when nobody is inside the space 3 (NO in step S13). This operation is immediately made effective, as shown in FIG. 16B. That is, when the user performs the unlocking operation, the door 32 is unlocked without any delay.

In this manner, if nobody is behind the door 32, the unlocking operation can immediately be made effective.

Sixth Example

A sixth example of the control operation executed by the informing controller 101 will be discussed below with reference to FIG. 17.

Figure 17:
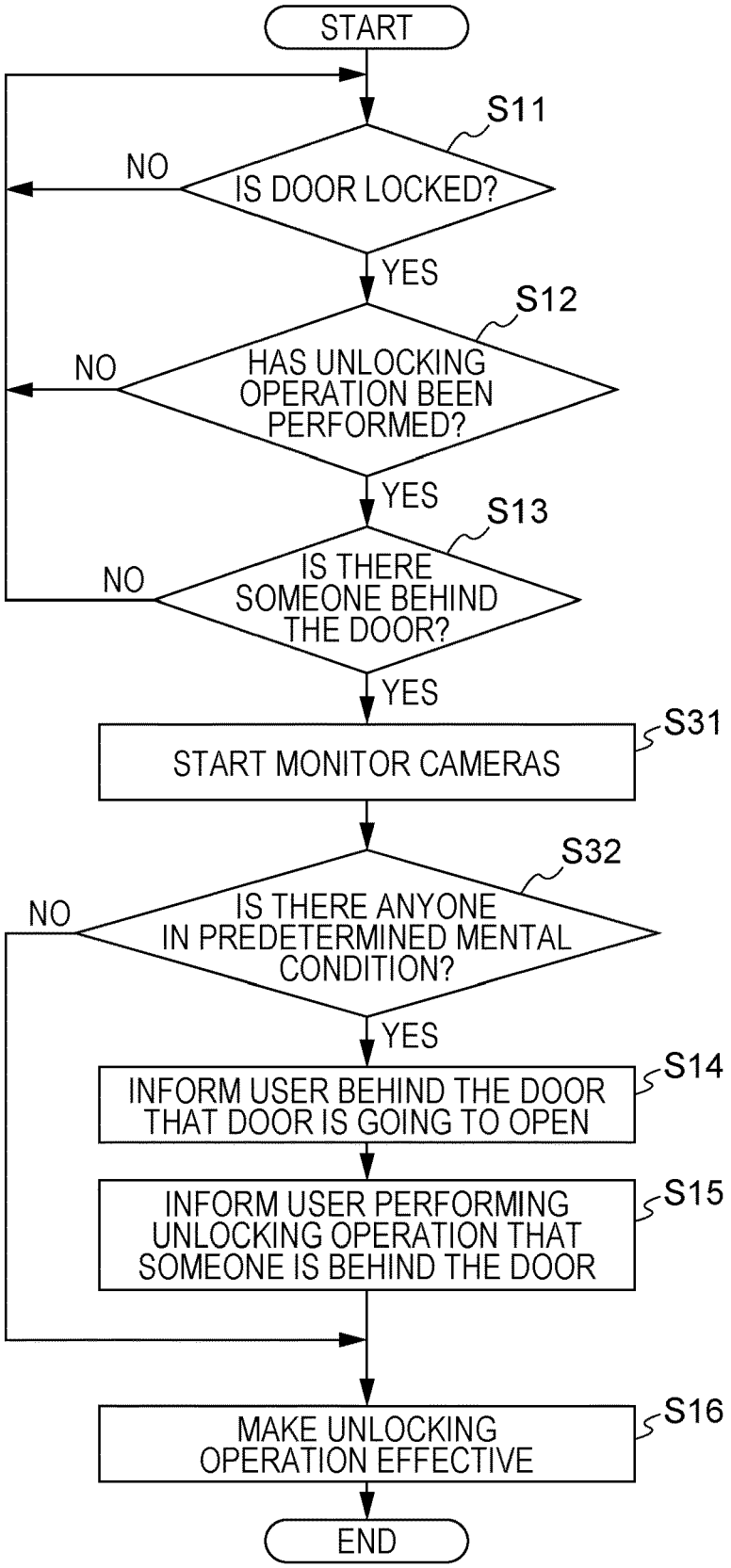
FIG. 17 is a flowchart illustrating an example of a control operation executed by the informing controller according to a sixth example.

FIG. 17 is a flowchart illustrating an example of the control operation executed by the informing controller 101 according to the sixth example. In FIG. 17, steps corresponding to those shown in FIG. 7 are designated by like step numbers.

In the sixth example, after the informing controller 101 has checked that someone is behind the door 32 by using the human sensor 31B (see FIG. 6), for example (YES in step S13), it starts the monitor cameras 31L installed inside and outside of the space 3 in step S31 so as to analyze the mental conditions of subject users by using imaging data in step S32.

If the monitor cameras 31L have already started, the informing controller 101 proceeds to step S32 by skipping step S31.

To analyze the mental condition, the technology for determining the mental condition of a subject user based on the amplitude and period pattern of vibrations that are observed in the face skin, eyeballs, mouth, and eyelids of the subject user may be utilized. This technology has already been put into practical use.

In the sixth example of the control operation, the informing controller 101 judges in step S32 whether there is any subject user in a predetermined mental condition. Steps S14 through S16 are executed only when the result of step S32 is YES. If a subject user is highly stressed out, getting aggressive, or nervous, it may overreact to the appearance of another person.

In the sixth example of the control operation, if there is any user in the predetermined mental condition, information about the presence of another person is given to the user to let the user calm down. Then, the unlocking operation is made effective.

Certain measures may also be taken for a user in the predetermined mental condition to calm down, such as telling this user about the presence of another person in a soft manner, with a female or child voice, using soothing aroma, instructing the user to take a deep breath, and displaying the image of another person behind the door 32 on the display device 31M.

The unlocking operation may not be made effective until a predetermined time elapses, as in the third example.

The unlocking operation may not be made effective before the subject user is found to have calmed down by analyzing its mental condition.

Additionally, a person to face the subject user in the predetermined mental condition may be told about the mental condition of this subject user or how to handle such a situation when providing information about the presence of another person behind the door 32.

When the door 32 is ready to be opened, the door opening-closing mechanism set 31J may be controlled to open the door 32 slowly.

In the example in FIG. 17, if it is found in S32 that nobody is in the predetermined mental condition, the unlocking operation is made effective in step S16 without providing information to the subject users.

Even if neither of the user indoors nor the user outdoors is in the predetermined mental condition, that is, even if a special warning is not required, information about the presence of another person may be provided to the user behind the door 32, as in the first through fifth examples.

If anyone in the predetermined mental condition is recognized and the occurrence of a crime is suggested, the unlocking operation may be terminated immediately to protect the other person. In this case, the reason why the door 32 is not unlocked may be provided and be reported to a security company.

Seventh Example

A seventh example of the control operation executed by the informing controller 101 will be discussed below with reference to FIG. 18.

Figure 18:
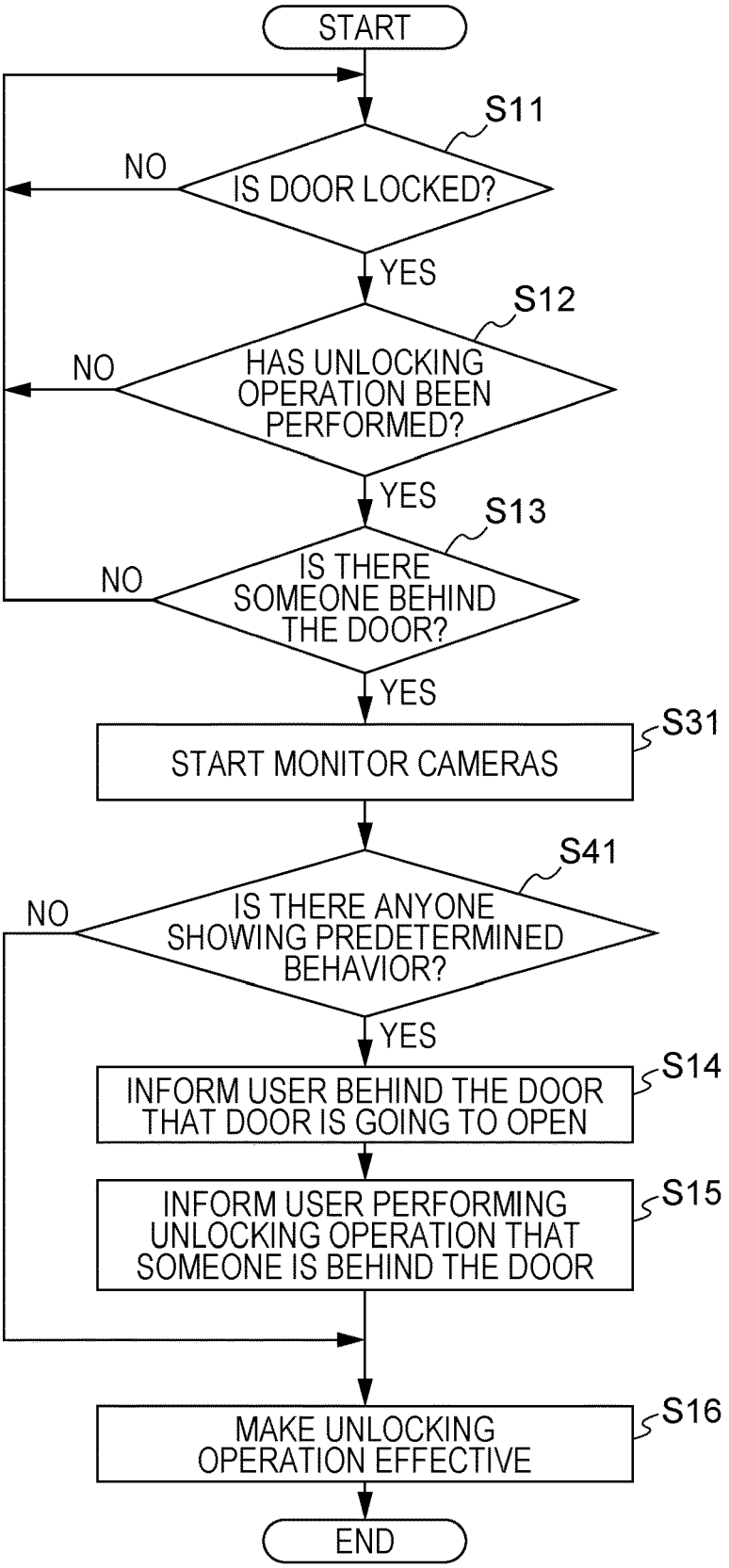
FIG. 18 is a flowchart illustrating an example of a control operation executed by the informing controller according to a seventh example.

FIG. 18 is a flowchart illustrating an example of the control operation executed by the informing controller 101 according to the seventh example. In FIG. 18, steps corresponding to those shown in FIG. 17 are designated by like step numbers.

In the sixth example, the mental conditions of subject users are analyzed by using imaging data output from the monitor cameras 31L. In the seventh example, the behavior of subject users is analyzed. For example, if a subject user is holding a dangerous object, talking loud, or angry, it may overreact to the appearance of another person.

In the seventh example of the control operation in FIG. 18, instead of executing step S32 in FIG. 17, the informing controller 101 judges in step S41 whether there is anyone showing predetermined behavior. Steps S14 through S16 are executed only when the result of step S41 is YES.

As in FIG. 17, if there is anyone showing the predetermined behavior, information about the presence of another person is given to the subject user to let the user calm down. Then, the unlocking operation is made effective.

As discussed in the sixth example, certain measures may also be taken for a person showing the predetermined behavior and for another person behind the door 32.

As in the example in FIG. 17, even if neither of the user indoors nor the user outdoors shows the predetermined behavior (NO in step S41), information about the presence of another person may be provided to a user behind the door 32.

If a person showing the predetermined behavior is recognized and the occurrence of a crime is suggested, the unlocking operation may be terminated immediately to protect the other person. In this case, the reason why the door 32 is not unlocked may be provided and be reported to a security company.

Eighth Example

An eighth example of the control operation executed by the informing controller 101 will be discussed below with reference to FIG. 19.

Figure 19:
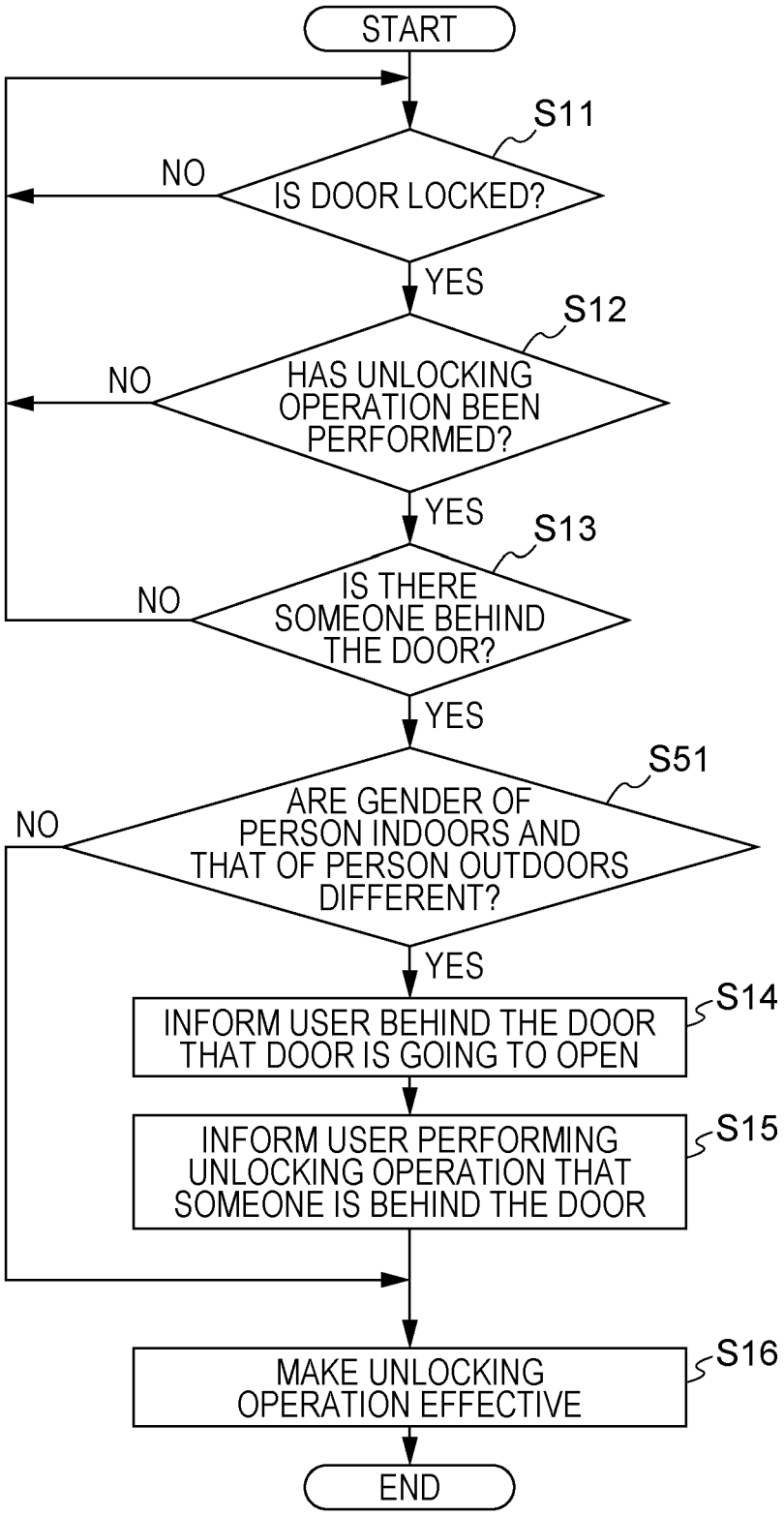
FIG. 19 is a flowchart illustrating an example of a control operation executed by the informing controller according to an eighth example.

FIG. 19 is a flowchart illustrating an example of the control operation executed by the informing controller 101 according to the eighth example. In FIG. 19, steps corresponding to those shown in FIG. 7 are designated by like step numbers.

If the result of step S13 is YES, the informing controller 101 judges whether the gender of a person indoors and that of a person outdoors are different in step S51. Usually, special consideration is required when a person faces someone of the opposite gender in a narrow, enclosed space.

The gender of a person indoors and that of a person outdoors may be checked by using information registered when a reservation has been made in a space 3 or may be identified by performing image processing on imaging data output from the monitor cameras 31L (see FIG. 6) installed indoors and outdoors. The gender may be identified based on the height and body shape or the pitch of the voice (high or low).

If the result of step S51 is YES, the informing controller 101 provides information about the presence of another person behind the door 32 in steps S14 and S15. The informing controller 101 then makes the unlocking operation effective in step S16.

In the eighth example, in step S14 or S15, information about the presence of a man indoors or outdoors may be provided only to a woman. If a woman is indoors, the predetermined time discussed in the third example may be provided before the unlocking operation is made effective and also be set to be longer.

If the result of step S51 is NO, the informing controller 101 makes the unlocking operation effective in step S16 by skipping steps S14 and S15.

Alternatively, even if the result of step S51 is NO, information about the presence of another person may be provided to a user behind the door 32. In this case, the content of information to be provided may be different from that in the first through seventh examples.

Ninth Example

A ninth example of the control operation executed by the informing controller 101 will be discussed below with reference to FIG. 20.

Figure 20:
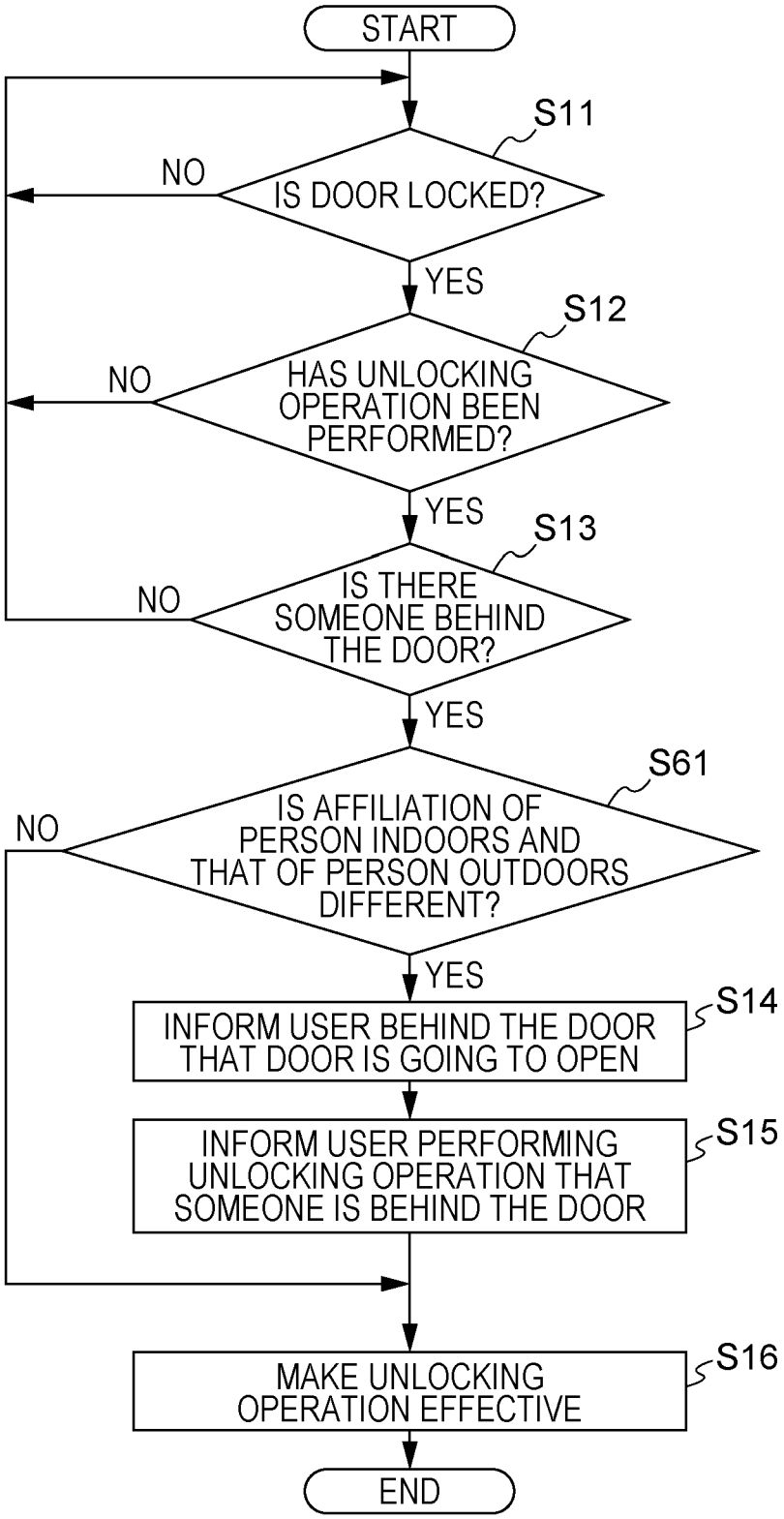
FIG. 20 is a flowchart illustrating an example of a control operation executed by the informing controller according to a ninth example.

FIG. 20 is a flowchart illustrating an example of the control operation executed by the informing controller 101 according to the ninth example. In FIG. 20, steps corresponding to those shown in FIG. 7 are designated by like step numbers.

In the ninth example, if the result of step S13 is YES, the informing controller 101 judges whether the affiliation of a user indoors and that of a user outdoors are different in step S61. The affiliation may be identified by using information registered when a reservation has been made in a space 3, for example. If the name of a legal entity of one user is different from that of the other user, the result of step S61 becomes YES. If the name of a legal entity of one user and that of the other user are the same, the result of step S61 becomes NO. If the two users belong to the same affiliation, they are less likely to be startled by the presence of the other person.

If the result of step S61 is YES, the informing controller 101 provides information about the presence of another person behind the door 32 in steps S14 and S15. The informing controller 101 then makes the unlocking operation effective in step S16.

If the result of step S61 is NO, the informing controller 101 makes the unlocking operation effective in step S16 by skipping steps S14 and S15.

Alternatively, even if the result of step S61 is NO, information about the presence of another person may be provided to the user behind the door 32. In this case, the content of information to be provided may be different from that in the first through eighth examples. For example, a user may be informed of the name of a person behind the door 32 or that the affiliation of a person behind the door 32 is the same as that of the user. Knowing that a person behind the door 32 is a colleague or a coworker, for example, the user is more likely to be assured than if it is a stranger.

Tenth Example

A tenth example of the control operation executed by the informing controller 101 will be discussed below with reference to FIG. 21.

Figure 21:
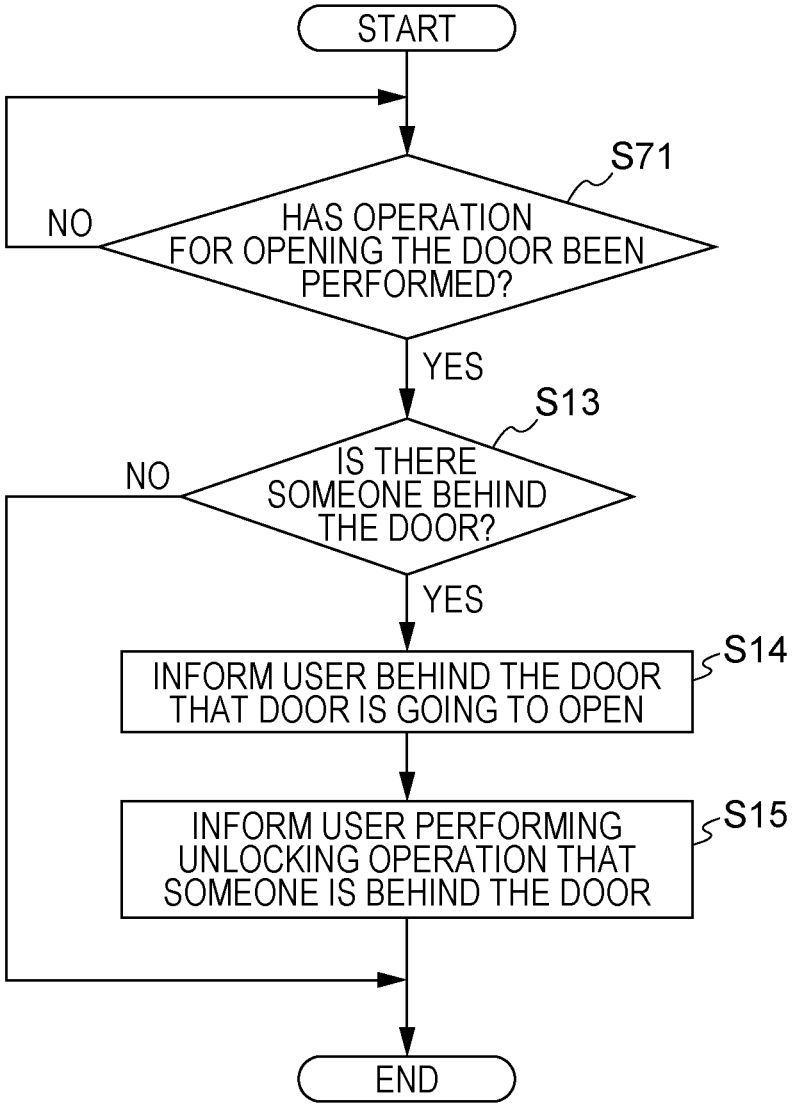
FIG. 21 is a flowchart illustrating an example of a control operation executed by the informing controller according to a tenth example.

FIG. 21 is a flowchart illustrating an example of the control operation executed by the informing controller 101 according to the tenth example. In FIG. 21, steps corresponding to those shown in FIG. 7 are designated by like step numbers.

The tenth example may be employed when the door 32 (see FIG. 2) does not have a locking function or when the door 32 is already unlocked.

In the tenth example, the informing controller 101 judges in step S71 whether an operation for opening the door 32 has been performed.

The operation for opening the door 32 is an example of an operation to set a door in a state in which the door will be opened. The operation for opening the door 32 may include a certain action suggesting that the operation for opening the door 32 will be performed, such as a gesture of extending a hand to the handle of the door 32 or touching the handle. The informing controller 101 may use imaging data output from the monitor camera 31L, for example, to judge whether the operation for opening the door 32 has been performed.

While the result of step S71 is NO, the informing controller 101 repeats step S71. If the operation for opening the door 32 has not been performed, nobody enters or leaves a space 3 and is not possibly startled by the presence of another person. This judgement is made regardless of whether a user is indoors. The operation for opening the door 32 may be performed either from indoors or from outdoors.

If the result of step S71 is YES, the informing controller 101 judges whether someone is behind the door 32 in step S13. If the result of step S13 is NO, there is no chance that a person indoors and that outdoors will face each other. The informing controller 101 thus terminates the processing. In this case, the user having performed the operation for opening the door 32 is free to enter and leave the space 3.

If the result of step S13 is YES, information is provided in steps S14 and S15. The user indoors and that outdoors are aware of the other person behind the door 32 and are less likely to be startled by the presence of the other person.

Other Exemplary Embodiments

The exemplary embodiment of the invention has been discussed above. However, the technical scope of the invention is not restricted to the exemplary embodiment. Various modifications and/or improvements may be made, and exemplary embodiments based on such modifications and improvements are also encompassed within the technical scope of the invention.

Figure 22:
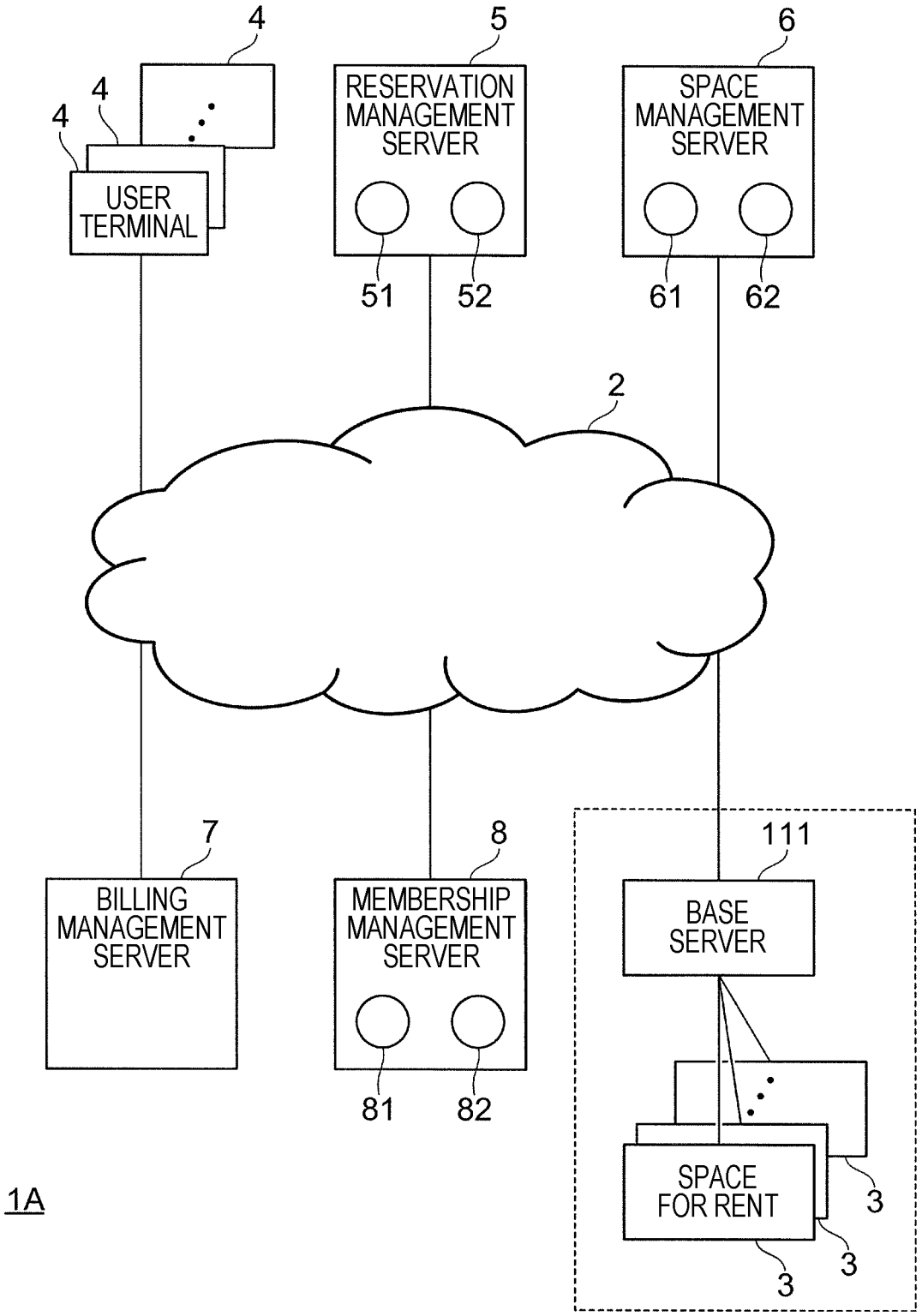
FIG. 22 schematically illustrates another example of the configuration of a management system.

The management system 1 (see FIG. 1) is not restricted to the above-described configuration. FIG. 22 schematically illustrates another example of the configuration of the management system 1, that is, the configuration of a management system 1A. In FIG. 22, elements corresponding to those in FIG. 1 are designated by like reference numerals. The management system 1A is different from the management system 1 in that a base server 111 is used for managing the plural spaces 3. The base server 111 configured as a computer may perform the functions of the informing controller 101 (see FIG. 6) by executing a program. In this sense, the base server 111 is an example of the apparatus.

In the above-described exemplary embodiment, a small room having a soundproof function, such as that shown in FIG. 2, is assumed as a space 3. However, meeting rooms, study rooms, and various types of guest rooms may be used as spaces 3 if reservations are required to be made for renting the spaces 3.

The above-described exemplary embodiment has been described, assuming that the door 32 can be locked. However, the above-described control function is still applicable when the door 32 is not possible to lock.

In the above-described exemplary embodiment, the spaces 3 are rented on a time basis. However, the spaces 3 may be rented based on another factor.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An apparatus comprising:

a controller that causes, when an operation to set a door in a state in which the door will be opened is performed on one side of the door and if someone is on the other side of the door, an informing unit to provide information that the door will be opened and someone is on the other side of the door, wherein the informing unit includes a first informing unit being disposed on the one side of the door and a second informing unit being disposed on the other side of the door, and the first and second informing units provide different messages when the operation is performed, wherein the controller determines whether to cause the informing unit to provide the information, based on at least one of a mental condition of a person inside a room and a mental condition of a person outside the room, the mental conditions being determined as a result of performing image processing, at least one of behavior of a person inside a room and behavior of a person outside the room, the behavior being estimated as a result of performing image processing, whether information concerning an affiliation of a person inside a room and information concerning an affiliation of a person outside the room satisfy a predetermined condition, or whether gender of a person inside a room and gender of a person outside the room are different, wherein the room is separated from the outside by the door.

2. The apparatus according to claim 1, wherein the operation is an unlocking operation.

3. The apparatus according to claim 2, wherein the controller causes the informing unit to provide the information after the unlocking operation has been detected.

4. The apparatus according to claim 2, wherein the controller causes the informing unit to provide the information before the unlocking operation is made effective.

5. The apparatus according to claim 2, wherein the controller causes the informing unit to provide the information if the unlocking operation is performed outside the room in a state in which someone is inside the room.

6. The apparatus according to claim 2, wherein the controller performs control so that the unlocking operation will be made effective after the controller has caused the informing unit to provide the information.

7. The apparatus according to claim 6, wherein the unlocking operation is made effective after the lapse of a predetermined time after the controller has caused the informing unit to provide the information.

8. The apparatus according to claim 6, wherein, if an operation for checking the information is performed by someone on the other side of the door, the door is unlocked.

9. The apparatus according to claim 2, wherein, if nobody is inside the room when the unlocking operation is detected, the door is unlocked without any delay when the unlocking operation is performed.

10. The apparatus according to claim 1, wherein the operation is an operation for opening the door.

11. The apparatus according to claim 10, wherein the controller causes the informing unit to provide the information after the operation for opening the door has been detected.

12. The apparatus according to claim 10, wherein the controller causes the informing unit to provide the information if the operation for opening the door is performed outside the room in a state in which someone is inside the room.

13. The apparatus according to claim 1, wherein the controller causes the informing unit to provide the information when the mental condition of one of the person inside the room and the person outside the room is a predetermined mental condition.

14. The apparatus according to claim 1, wherein the controller causes the informing unit to provide the information when the behavior of one of the person inside the room and the person outside the room is predetermined behavior.

15. The apparatus according to claim 1, wherein the predetermined condition is a condition that the affiliation of the person inside the room and the affiliation of the person outside the room are different.

16. The apparatus according to claim 15, wherein a registered name of a legal entity of the person inside the room and a registered name of a legal entity of the person outside the room are different.

17. The apparatus according to claim 1, wherein the door is located opposite a desk disposed inside the room with a chair interposed between the door and the desk.

18. A management system comprising:

a controller that causes, when an operation to set a door in a state in which the door will be opened is performed on one side of the door and if someone is on the other side of the door, an informing unit to provide information that the door will be opened and someone is on the other side of the door, wherein the informing unit includes a first informing unit being disposed on the one side of the door and a second informing unit being disposed on the other side of the door, and the first and second informing units provide different messages when the operation is performed, wherein the controller determines whether to cause the informing unit to provide the information, based on at least one of a mental condition of a person inside a room and a mental condition of a person outside the room, the mental conditions being determined as a result of performing image processing, at least one of behavior of a person inside a room and behavior of a person outside the room, the behavior being estimated as a result of performing image processing, whether information concerning an affiliation of a person inside a room and information concerning an affiliation of a person outside the room satisfy a predetermined condition, or whether gender of a person inside a room and gender of a person outside the room are different, wherein the room is separated from the outside by the door.

19. A non-transitory computer readable medium storing a program causing a computer to execute a process, the process comprising:

causing, when an operation to set a door in a state in which the door will be opened is performed on one side of the door and if someone is on the other side of the door, an informing unit to provide infoi nation that the door will be opened and someone is on the other side of the door, wherein the informing unit includes a first informing unit being disposed on the one side of the door and a second informing unit being disposed on the other side of the door, and the first and second informing units provide different messages when the operation is performed; and determining whether to cause the informing unit to provide the information, based on at least one of a mental condition of a person inside a room and a mental condition of a person outside the room, the mental conditions being determined as a result of performing image processing, at least one of behavior of a person inside a room and behavior of a person outside the room, the behavior being estimated as a result of performing image processing, whether information concerning an affiliation of a person inside a room and information concerning an affiliation of a person outside the room satisfy a predetermined condition, or whether gender of a person inside a room and gender of a person outside the room are different, wherein the room is separated from the outside by the door.

* * * * *